US007334869B2

(12) United States Patent
Mizuno

(10) Patent No.: US 7,334,869 B2
(45) Date of Patent: Feb. 26, 2008

(54) PRINTING SYSTEM, PRINTING METHOD, AND ADJUSTMENT METHOD

(75) Inventor: Hidekazu Mizuno, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 170 days.

(21) Appl. No.: 11/362,797

(22) Filed: Feb. 28, 2006

(65) Prior Publication Data

US 2006/0203022 A1 Sep. 14, 2006

(30) Foreign Application Priority Data

Mar. 1, 2005 (JP) ..... 2005-056610

(51) Int. Cl.
*B41J 2/21* (2006.01)

(52) U.S. Cl. ..... 347/43

(58) Field of Classification Search ..... None
See application file for complete search history.

(56) References Cited

U.S. PATENT DOCUMENTS 4,344,079 A * 8/1982 Chambors et al. ..... 347/12
6,532,026 B2 * 3/2003 Takahashi et al. ..... 347/41
6,595,612 B1 * 7/2003 Brown et al. ..... 347/9

FOREIGN PATENT DOCUMENTS

JP 2000-318145 A 11/2000

* cited by examiner

*Primary Examiner*—K. Feggins
(74) *Attorney, Agent, or Firm*—Sughrue Mion, PLLC

(57) ABSTRACT

A printing system includes a head, a carry unit, a memory, and a controller. The head has nozzles and ejects ink droplets corresponding to pixel data from each of the nozzles. The carry unit carries a medium. The memory stores position information that indicates a relationship between a position of a dot to be formed by an ink droplet ejected according to the pixel data and a position of a pixel on the medium corresponding to that pixel data. The controller alternately repeats a dot formation operation of causing ejection of the ink droplets from the nozzles which move in a movement direction to form the dots in the movement direction, and a carrying operation of causing the carry unit to carry the medium, to print an image on the medium. When forming a row of dots lined up in the movement direction with a predetermined number of at least two nozzles by repeating the dot formation operation of forming dots at a predetermined pitch in the movement direction and shifting the positions, in the movement direction, of the dots formed in each dot formation operation, the controller divides a plurality of pieces of the pixel data that correspond to a plurality of the pixels lined up in the movement direction into groups of a number equal to the predetermined number, assigns, based on the position information, one of the predetermined number of groups to each of the dot formation operations that are repeated, and, in each dot formation operation, causes ejection of the ink droplets based on the pixel data included in the group that has been assigned.

13 Claims, 35 Drawing Sheets

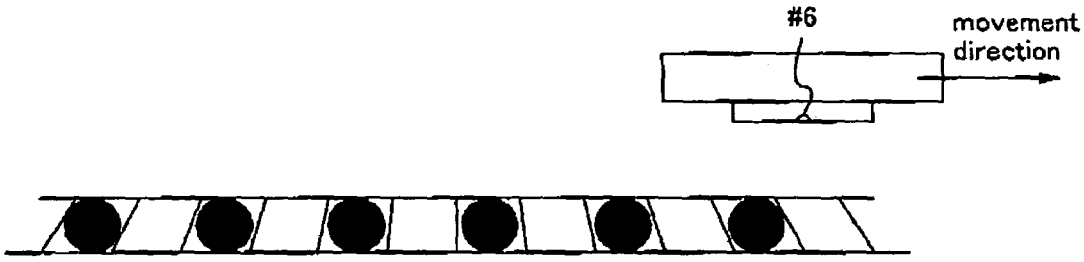
Fig. 11A how dots are formed in pass 4
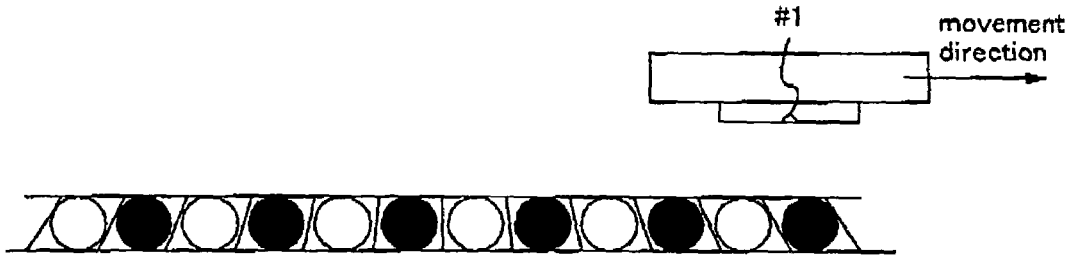
Fig. 11B how dots are formed in pass 8

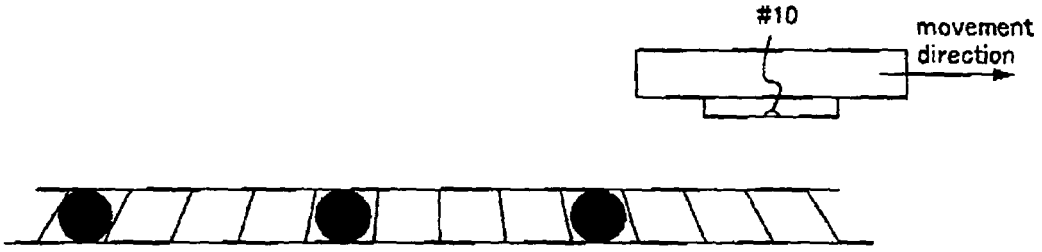
Fig. 13A how dots are formed in pass 4
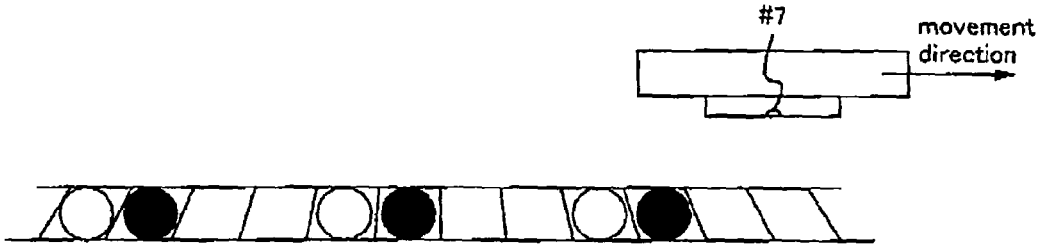
Fig. 13B how dots are formed in pass 8
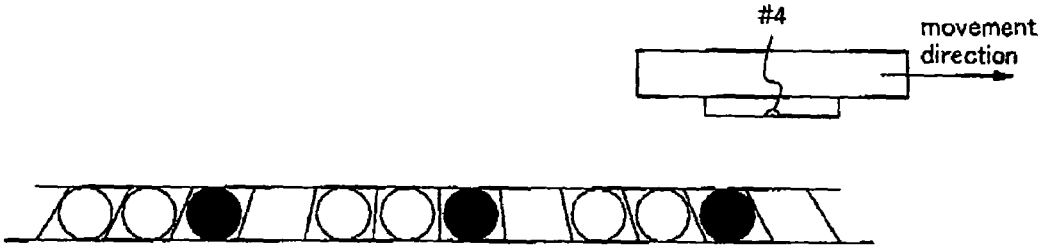
Fig. 13C how dots are formed in pass 12
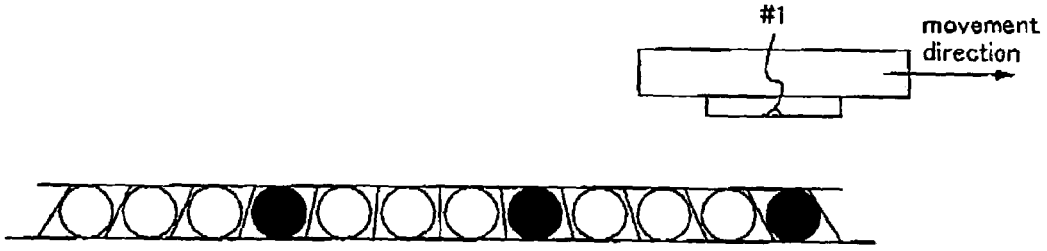
Fig. 13D how dots are formed in pass 16

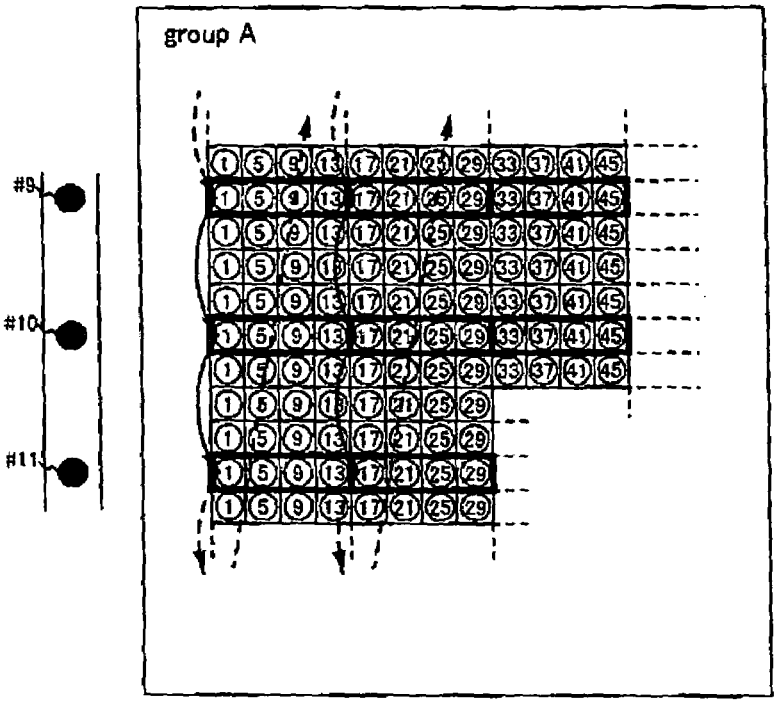
Fig. 19A pixel data of pass 4
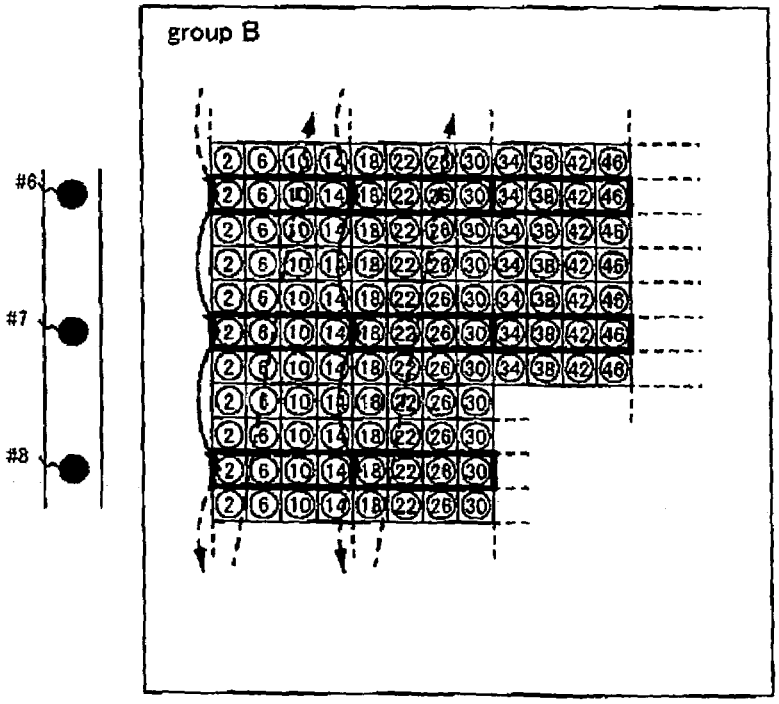
Fig. 19B pixel data of pass 8

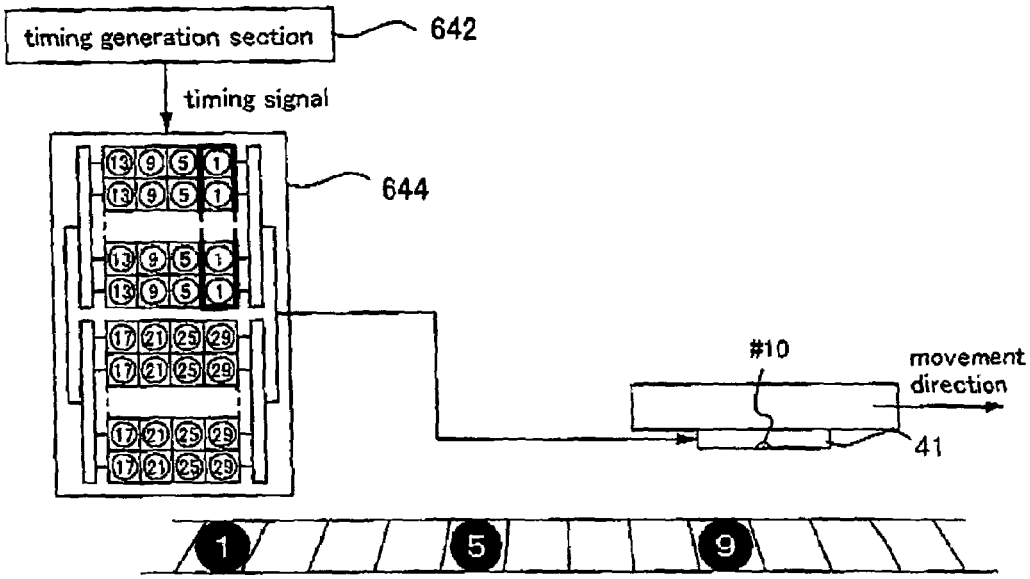
Fig. 21A how dots are formed in pass 4
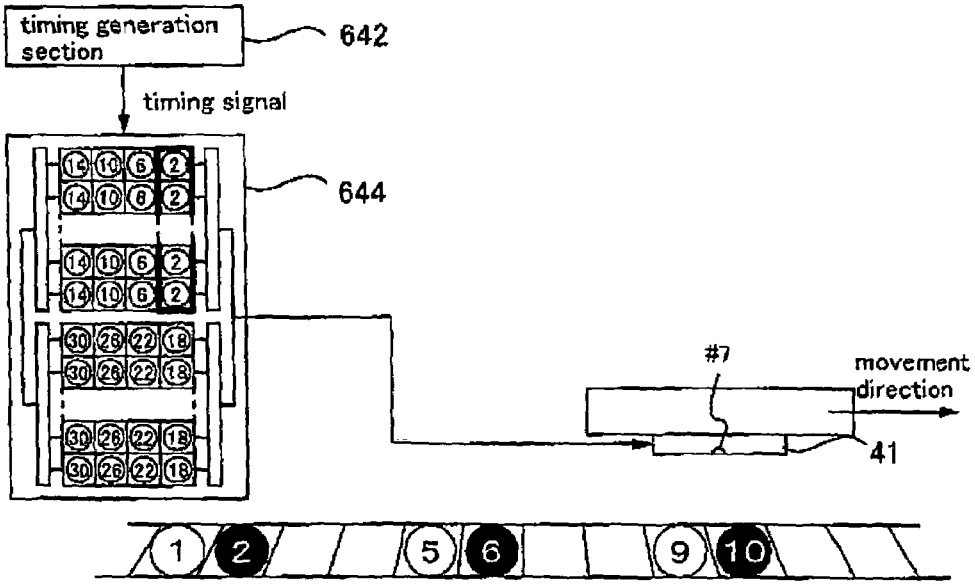
Fig. 21B how dots are formed in pass 8

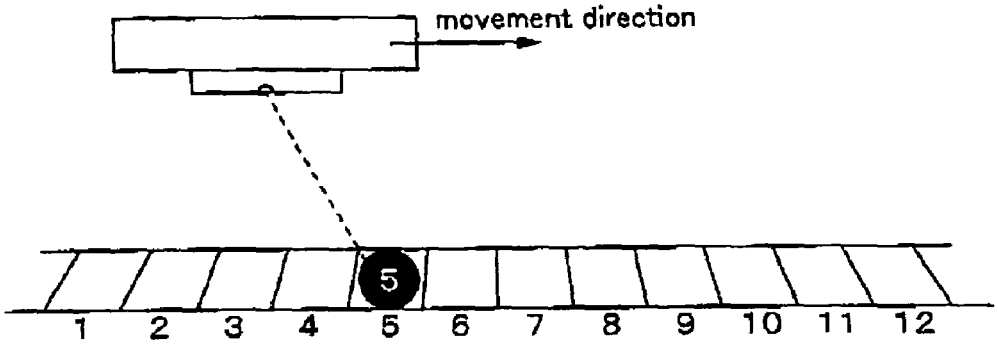
Fig. 23A how a dot is formed under normal conditions
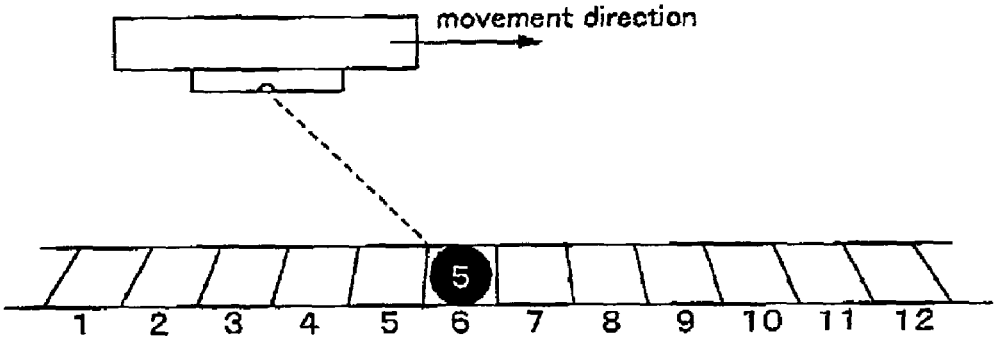
Fig. 23B how a dot is formed when the flight speed is slow
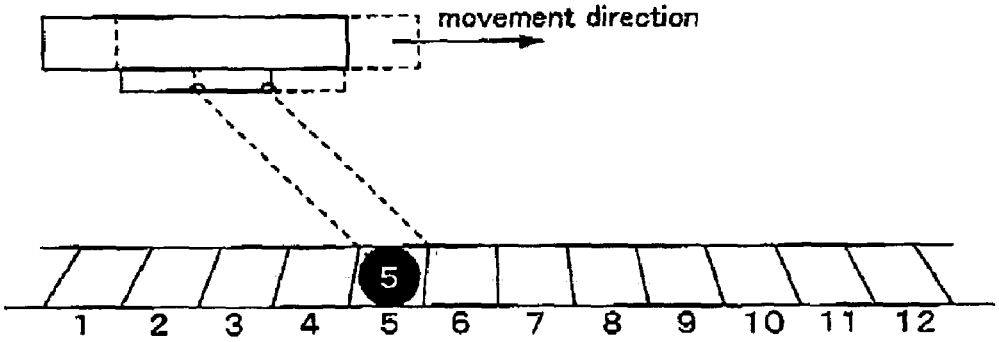
Fig. 23C when the dot formation position has been corrected

| | ink | | | |
|---|---|---|---|---|
| | Y | M | C | K |
| adjustment value | −1 | +2 | +1 | −1 |

Fig. 24

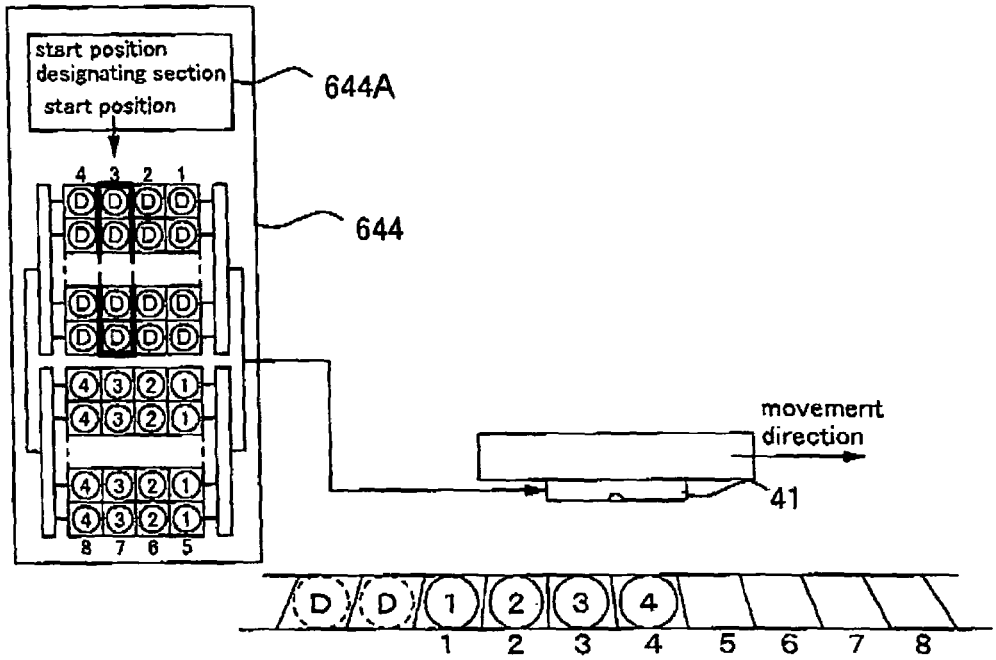
Fig. 26A when starting from region 3
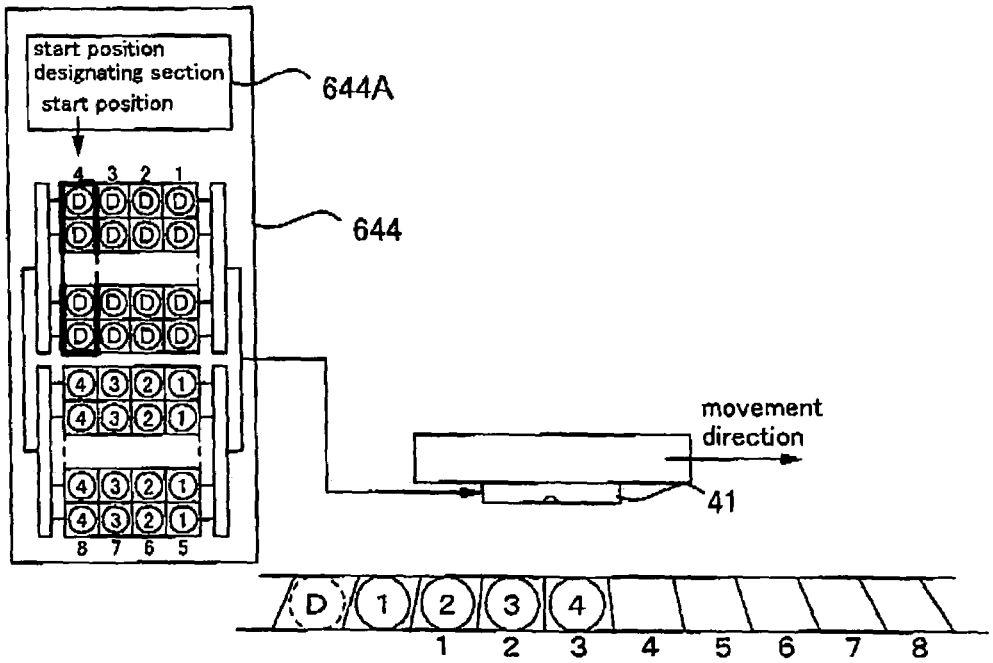
Fig. 26B when starting from region 4

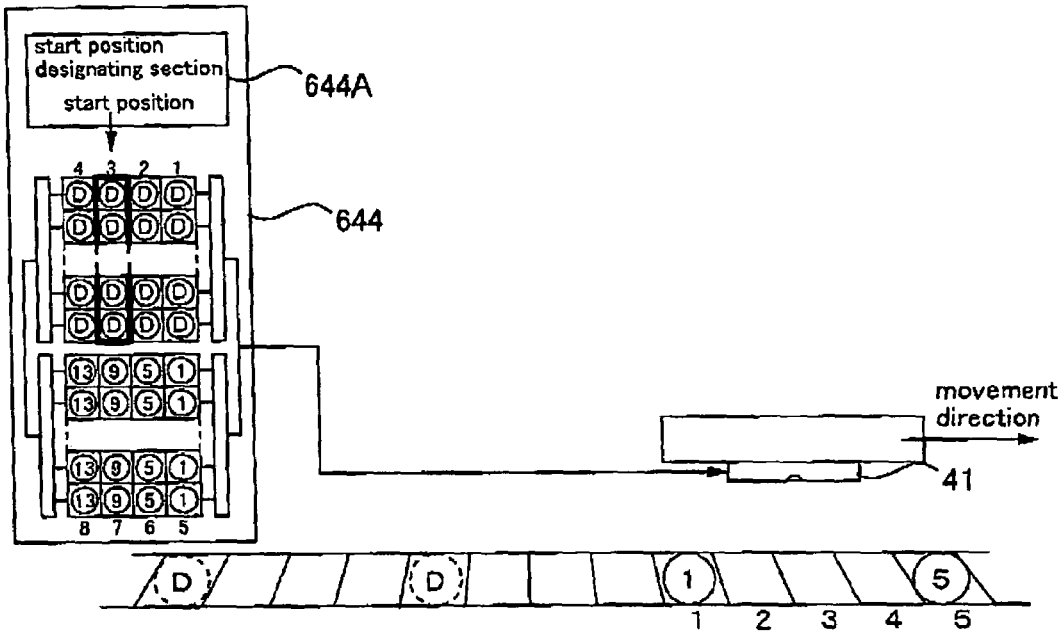
Fig. 27A when adjustment value is "0" (ink droplets are ejected normally)
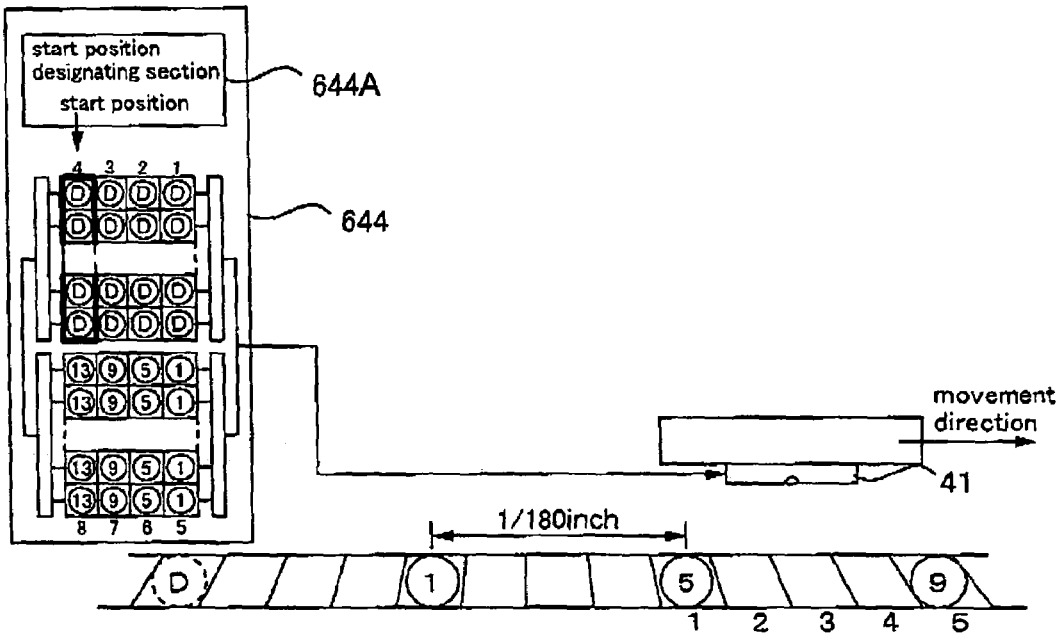
Fig. 27B when adjustment value is "-1" (ink droplets are ejected normally)

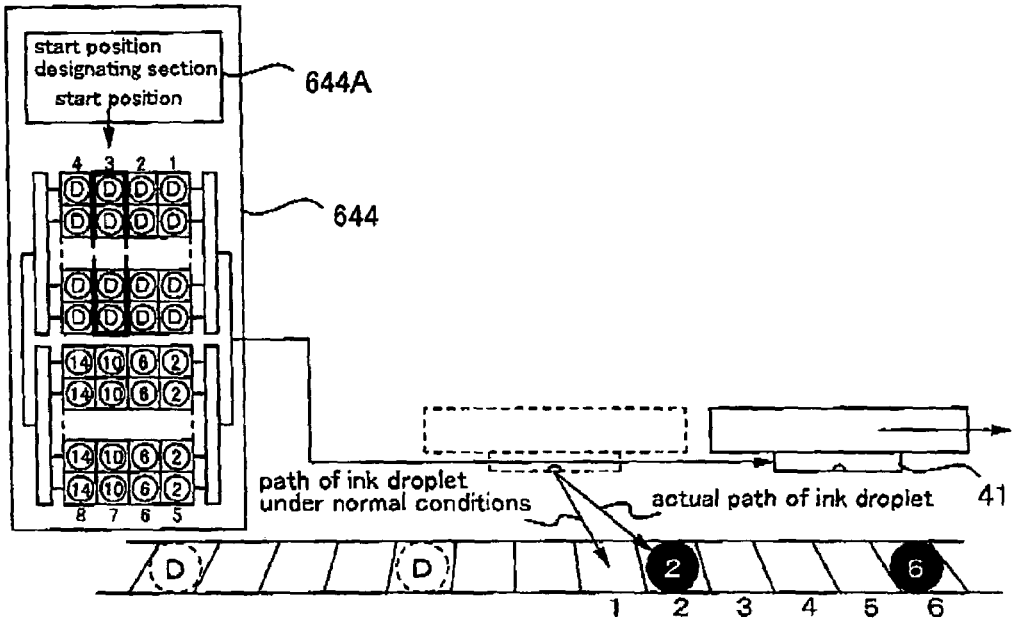
Fig. 31A how dots are formed in pass 4 when the adjustment value is "-1"
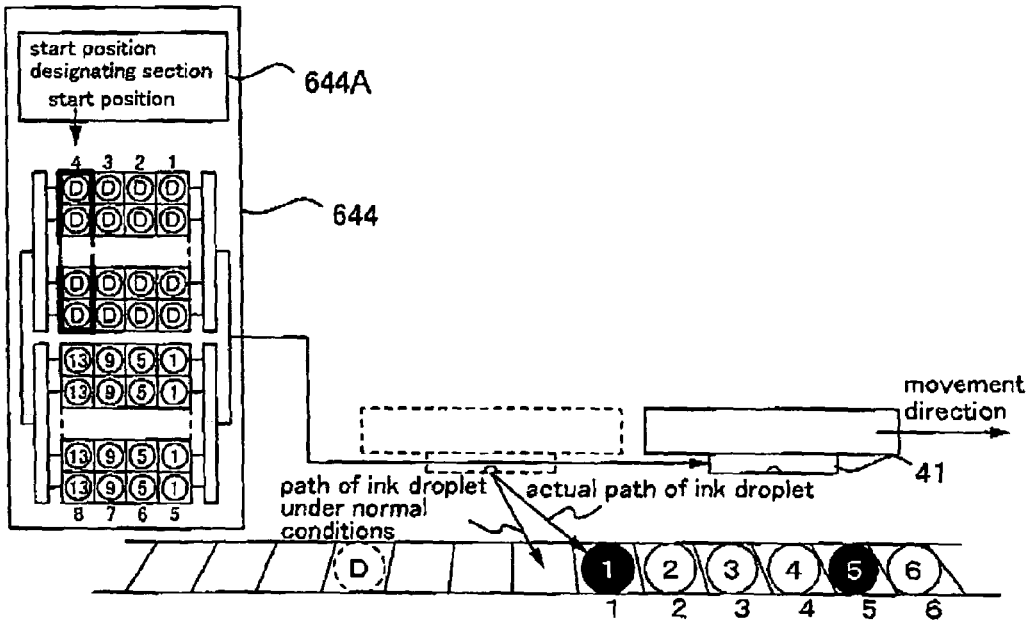
Fig. 31B how dots are formed in pass 16 when the adjustment value is "-1"

pixel data of pass 8

PRINTING SYSTEM, PRINTING METHOD, AND ADJUSTMENT METHOD

CROSS-REFERENCE TO ELATED APPLICATIONS

The present application claims priority upon Japanese Patent Application No. 2005-056610 filed on Mar. 1, 2005, which is herein incorporated by reference.

BACKGROUND

1. Technical Field

The present invention relates to printing systems, printing methods, and adjustment methods.

2. Related Art

So-called inkjet printers alternately repeat a dot formation operation of ejecting ink droplets from nozzles that move in a movement direction to form dots, and a carrying operation of carrying a medium such as paper in a carrying direction, to print an image on the medium. When ink droplets are ejected from the nozzles normally, the ink droplets land in predetermined pixels on the paper and form dots in those predetermined pixels on the paper.

In actual printers, however, the speed at which the ink droplets travel and the spacing between the nozzles and the paper, for example, are not as expected, and this leads to instances where dots are not formed where expected.

Accordingly, in one method that has been practiced, dummy pixel data (dummy data) known as adjustment pixels are added to the left and the right of the raster data to adjust the positions where dots are formed (see JP-A-2000-318145).

This adjustment method requires a computation process to add and delete the dummy data in accordance with the adjustment amount. Adding and deleting dummy data in accordance with the adjustment amount, however, increases the computational burden.

SUMMARY

An advantage of some aspects of the present invention is that it is possible to lighten the computational burden when adjusting shifting in the positions where ink droplets land.

An aspect of the invention is a printing system including:

(A) a head that is furnished with a plurality of nozzles and that ejects ink droplets that correspond to pixel data from each of the nozzles;

(B) a carry unit that carries a medium;

(C) a memory storing position information that indicates a relationship between a position of a dot to be formed by an ink droplet that is ejected according to the pixel data and a position of a pixel on the medium that corresponds to that pixel data; and (D) a controller that alternately repeats a dot formation operation of causing ejection of the ink droplets from the nozzles which move in a movement direction to form the dots in the movement direction, and a carrying operation of causing the carry unit to carry the medium, to print an image on the medium;

wherein, when forming a row of dots lined up in the movement direction with a predetermined number of at least two nozzles by repeating the dot formation operation of forming dots at a predetermined pitch in the movement direction and shifting the positions, in the movement direction, of the dots that are formed in each dot formation operation, the controller divides a plurality of pieces of the pixel data that correspond to a plurality of the pixels lined up in the movement direction into groups of a number equal to the predetermined number, assigns, based on the position information, one of the predetermined number of groups to each of the dot formation operations that are repeated, and in each dot formation operation, causes ejection of the ink droplets based on the pixel data included in the group that has been assigned.

Other features of the present invention will be made clear through the present specification with reference to the accompanying drawings

BRIEF DESCRIPTION OF THE DRAWINGS

For a more complete understanding of the present invention and the advantages thereof, reference is now made to the following description taken in conjunction with the accompanying drawings wherein:

FIG. 11A shows how dots are formed in pass 4, and FIG. 11B shows how dots are formed in pass 8;

FIGS. 13A through 13D are explanatory diagrams of how the dots of a certain raster line are formed in a case where a single raster line is formed by four nozzles (M=4);

FIG. 19A is an explanatory diagram of the order in which the pixel data of pass 4 are arranged, and FIG. 19B is an explanatory diagram of the order in which the pixel data of pass 8 are arranged;

FIG. 21A is an explanatory diagram of how dots are formed in pass 4, and FIG. 21B is an explanatory diagram of how dots are formed in pass 5;

FIG. 23A is an explanatory diagram of how dots are formed under normal conditions, FIG. 23B is an explanatory diagram of how dots are formed when the flight speed is slow, and FIG. 23C is an explanatory diagram of how the dot formation positions are adjusted;

FIG. 24 is an explanatory diagram of the adjustment value table;

FIGS. 26A and 26B are explanatory diagrams of the adjustment method of the second reference example;

FIGS. 27A and 27B are explanatory diagrams of a case in which the adjustment method of the second reference example has been adopted for overlapped printing;

FIGS. 31A and 31B are explanatory diagrams of the dot formation operation when the adjustment value is "−1;"

DESCRIPTION OF EXEMPLARY EMBODIMENTS

Figure 1:
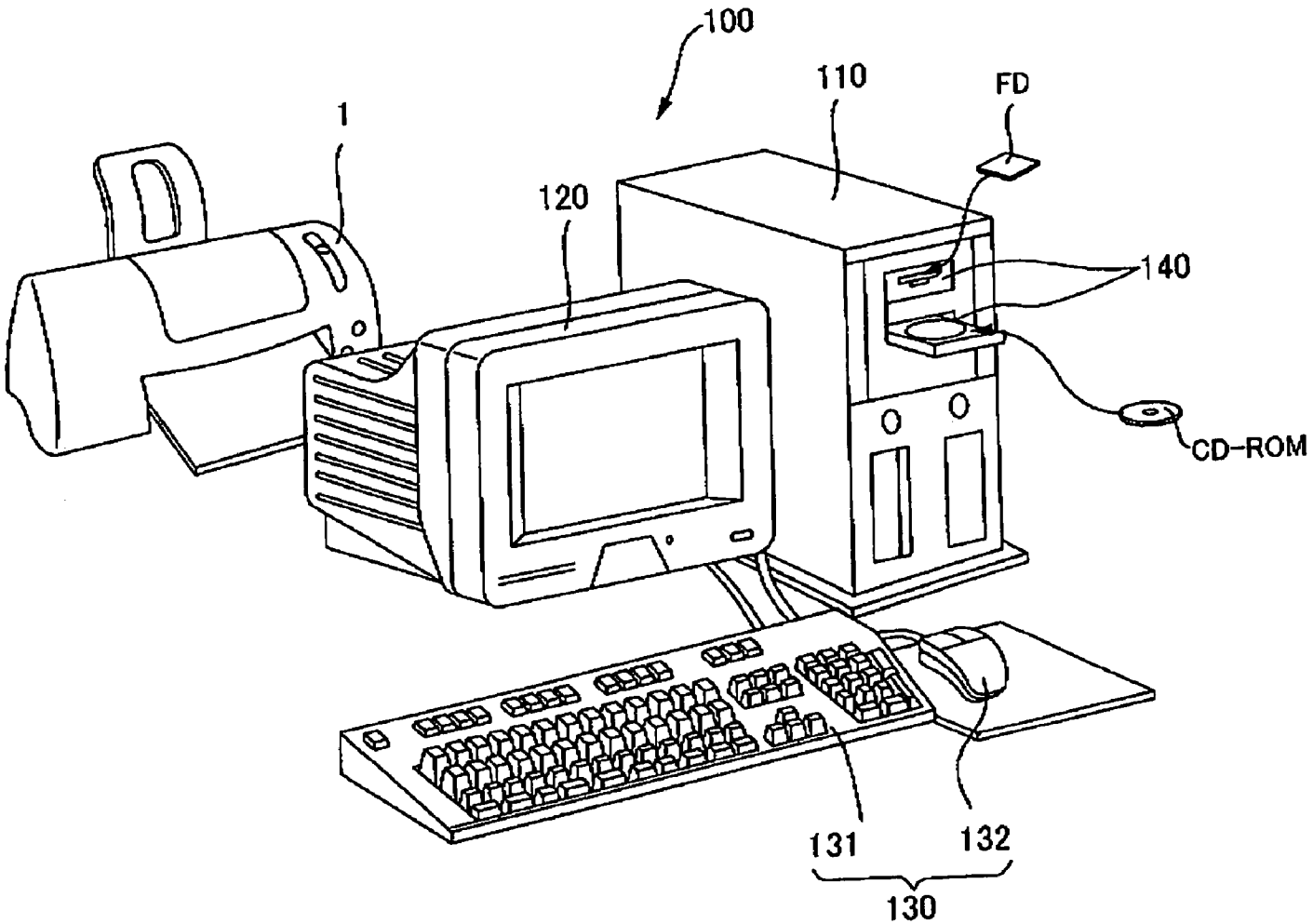
FIG. 1 is a diagram for describing the configuration of a printing system 100.

At least the following matters will become clear through the description of the present specification and the accompanying drawings.

A printing system includes:

(A) a head that is furnished with a plurality of nozzles and that ejects ink droplets that correspond to pixel data from each of the nozzles;

(B) a carry unit that carries a medium;

(C) a memory storing position information that indicates a relationship between a position of a dot to be formed by an ink droplet that is ejected according to the pixel data and a position of a pixel on the medium that corresponds to that pixel data; and (D) a controller that alternately repeats a dot formation operation of causing ejection of the ink droplets from the nozzles which move in a movement direction to form the dots in the movement direction, and a carrying operation of causing the carry unit to carry the medium, to print an image on the medium;

wherein, when forming a row of dots lined up in the movement direction with a predetermined number of at least two nozzles by repeating the dot formation operation of forming dots at a predetermined pitch in the movement direction and shifting the positions, in the movement direction, of the dots that are formed in each dot formation operation, the controller divides a plurality of pieces of the pixel data that correspond to a plurality of the pixels lined up in the movement direction into groups of a number equal to the predetermined number, assigns, based on the position information, one of the predetermined number of groups to each of the dot formation operations that are repeated, and in each dot formation operation, causes ejection of the ink droplets based on the pixel data included in the group that has been assigned.

This printing system allows to lighten the computational burden when adjusting the shift in the positions where ink droplets land.

In this printing system, it is preferable that the controller changes an ejection start timing for starting ejection of the ink droplets in each dot formation operation in accordance with the position information. By doing this, the computation for adding dummy data that correspond to the adjustment value is no longer necessary, and this allows the computational burden to be lightened.

In this printing system, it is preferable that the printing system further includes a printing apparatus that has a portion of the controller, and a print control apparatus that has a portion of the controller and that controls the printing apparatus; the memory is provided in the printing apparatus; the controller on the print control apparatus side reads the position information from the memory, creates print data for each dot formation operation based on the position information, and sends the print data to the printing apparatus; and the controller on the printing apparatus side receives the print data from the print control apparatus and causes the ink droplets to be ejected based on the print data. Thus, the printing apparatus can adjust the landing positions of the ink droplets.

In this printing system, it is preferable that, when causing the ink droplets to be ejected based on the print data, the controller on the printing apparatus side reads the position information from the memory and changes the ejection start timing for starting ejection of the ink droplets in each dot formation operation based on this position information. This obviates the need to include position information in the print data.

In this printing system, it is preferable that the controller on the print control apparatus side includes, in the print data, the position information that it has read from the memory and then sends the print data to the printing apparatus; and the controller on the printing apparatus side changes the ejection start timing for starting ejection of the ink droplets in each dot formation operation based on the position information that has been included in the print data. This allows the print control apparatus to control the ejection start timing.

In this printing system, it is preferable that the dot formation operation performed by the controller is not based on the position information in a case where: the controller causes bidirectional printing to be performed; and the position information takes a predetermined value. Further, it is preferable that the dot formation operation performed by the controller is not based on the position information in a case where: when the position information indicates that there is no shifting in the relationship, two pieces of pixel data that correspond to two pixels that are separated by 2×n pixels are respectively assigned to dot formation operations in which the nozzles are moved in opposite directions; and the position information indicates that the relationship is shifted by n pixels. This is because in such cases, there are pixels in which dots cannot be formed.

In this printing system, it is preferable that the controller assigns one of the predetermined number of groups to each of the dot formation operations that are repeated, like when the position information indicates that there is no positional shifting in the relationship. Thus, it is possible to eliminate the computational burden that is associated with the adjustment process.

In this printing system, it is preferable that the controller assigns one of the predetermined number of groups to each of the dot formation operations that are repeated, like when the position information indicates that the relationship is shifted by n+1 pixels or n−1 pixels. By doing this, it is possible for the user to obtain a higher-quality print image than when adjustment is not performed.

In this printing system, it is preferable that a storage section storing the pixel data stores a plurality of pieces of pixel data in one address. In this case, although there is an increased likelihood that the computational burden will become large, there is an effect that the computational burden can be kept low as long as dummy data that correspond to the adjustment value are not added or deleted.

In this printing system, it is preferable that the head is provided with a plurality of the nozzles for each color; and the controller causes the ink droplets to be ejected from the plurality of the nozzles for each color at a common timing. Thus, the apparatus can be simplified.

A printing method includes:

(A) alternately repeating, a dot formation operation of ejecting ink droplets that correspond to pixel data from a plurality of nozzles that move in a movement direction, to form dots in the movement direction, and a carrying operation of carrying a medium, to print an image on the medium;

(B) storing, in advance, position information that indicates a relationship between a position of a dot to be formed by an ink droplet that is ejected according to the pixel data and a position of a pixel on the medium that corresponds to that pixel data; and (C) when forming a row of dots lined up in the movement direction with a predetermined number of at least two nozzles by repeating the dot formation operation of forming dots at a predetermined pitch in the movement direction and shifting the positions, in the movement direction, of the dots that are formed in each dot formation operation, dividing a plurality of pieces of the pixel data that correspond to a plurality of the pixels lined up in the movement direction into groups of a number equal to the predetermined number, assigning, based on the position information, one of the predetermined number of groups to each of the dot formation operations that are repeated, and in each dot formation operation, causing ejection of the ink droplets based on the pixel data included in the group that has been assigned.

This printing method allows to lighten the computational burden when adjusting the shift in the positions where ink droplets land.

An adjustment method for a printing apparatus that alternately repeats a dot formation operation of ejecting ink droplets that correspond to pixel data from a plurality of nozzles that move in a movement direction, to form dots in the movement direction, and a carrying operation of carrying a medium, to print an image on the medium, includes:

(A) storing, in advance, position information that indicates a relationship between a position of a dot to be formed by an ink droplet that is ejected according to the pixel data and a position of a pixel on the medium that corresponds to that pixel data; and (B) when forming a row of dots lined up in the movement direction with a predetermined number of at least two nozzles by repeating the dot formation operation of forming dots at a predetermined pitch in the movement direction and shifting the positions, in the movement direction, of the dots that are formed in each dot formation operation, dividing a plurality of pieces of the pixel data that correspond to a plurality of the pixels lined up in the movement direction into groups of a number equal to the predetermined number, assigning, based on the position information, one of the predetermined number of groups to each of the dot formation operations that are repeated, and in each dot formation operation, causing ejection of the ink droplets based on the pixel data included in the group that has been assigned.

This adjustment method allows to lighten the computational burden when adjusting the shift in the positions where ink droplets land.

(1) Printing System

First, the printing apparatus will be described in conjunction with a printing system. It should be noted that the printing system refers to a system including at least a printing apparatus and a print control apparatus for controlling the operation of this printing apparatus. The printing system of this embodiment is provided with a printer 1 and a computer that is installed with a printer driver.

FIG. 1 is a diagram for describing a configuration of a printing system 100. This illustrative printing system 100 shown here includes a printer 1 as a printing apparatus and a computer 110 as a print control apparatus. Specifically, the printing system 100 includes the printer 1, the computer 110, a display device 120, an input device 130, and a record/play device 140.

The printer 1 prints images on media such as paper, cloth, film, and OHP paper. It should be noted that in the following description, a paper S (see FIG. 4), which is a representative medium, serves as an illustrative example of such media. The computer 110 is communicably connected to the printer 1. To print an image with the printer 1, the computer 110 outputs print data corresponding to that image to the printer 1. computer programs such as an application program and a printer driver are installed on the computer 110.

(1-1) Printer Driver

Figure 2:
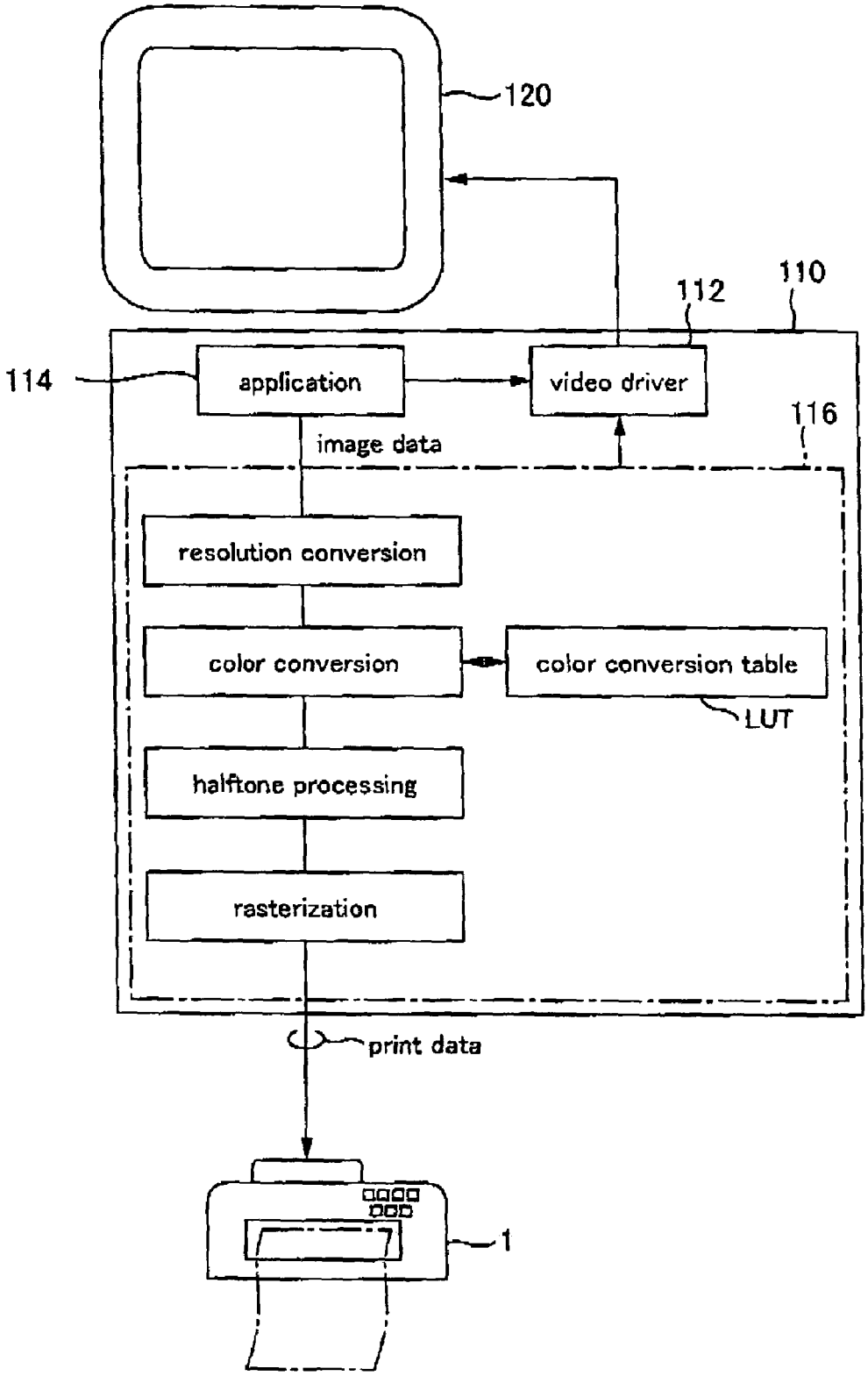
FIG. 2 is an explanatory diagram that schematically illustrates the basic processing performed by the printer driver.

FIG. 2 is a schematic explanatory diagram of basic processes carried out by the printer driver.

On the computer 110, computer programs such as a video driver 112, an application program 114, and a printer driver 116 run under an operating system that has been installed on the computer. The video driver 112 has a function of displaying a user interface, for example, on the display device 120 in accordance with a display command from the application program 114 or the printer driver 116. The application program 114 has, for example, a function for image editing or the like and creates data related to an image (image data). A user can give an instruction to print an image that has been edited by the application program 114 via the user interface of the application program 114. When it has received the print instruction, the application program 114 outputs the image data to the printer driver 116.

The printer driver 116 receives the image data from the application program 114, converts the image data to print data, and outputs the print data to the printer. Here, "print data" refers to data in a format that can be interpreted by the printer 1 and that includes various command data and pixel data. Here, "command data" refers to data for instructing the printer to carry out a specific operation. Furthermore, "pixel data" refers to data relating to pixels that constitute an image to be printed (print image), such as data relating to the dot to be formed at a position on the paper (pixel on the paper) corresponding to a certain pixel (e.g., data about the dot color and size).

In order to convert the image data that are output from the application program 114 to print data, the printer driver 116 carries out processing such as resolution conversion, color conversion, halftone processing, and rasterization. The following is a description of the processes carried out by the printer driver 116.

Resolution conversion is processing in which image data (text data, image data, etc.) output from the application program 114 are converted to a resolution for when printing on paper. For example, when the resolution for printing an image on paper is designated to be 720×720 dpi, then the image data received from the application program 114 are converted to image data at a resolution of 720×720 dpi. It should be noted that the image data after resolution conversion are RGB data in multiple gradations (for example, 256 gradations) that are expressed in an RGB color space.

Color conversion is processing for converting RGB data into CMYK data that are expressed in CMYK color space. It should be noted that CMYK data are data that correspond to the colors of ink in the printer. Color conversion is carried out by the printer driver 116 referencing a table (a color conversion look-up table LUT) that associates the gradation values of RGB image data with the gradation values of CMYK image data. Due to color conversion, the RGB data for the pixels are converted to CMYY data that correspond to the ink colors. It should be noted that the data after color conversion are CMYK data in 256 gradations that are expressed by a CMYK color space.

Halftone processing is processing for converting data having a high number of gradations into data having a number of gradations that can be formed by the printer. For example, through halftone processing, data that indicate 256 gradations are converted to 1-bit data that indicate two gradations or 2-bit data that indicate four gradations. Halftone-processed data have a resolution that is equal to the above-mentioned RGB data (for example, 720×720 dpi). In this embodiment, the halftone-processed image data are made of 2-bit pixel data for each pixel.

Rasterization is processing for changing the image data in a matrix form to the order in which they are to be transferred to the printer. The pasteurized data are output to the printer as pixel data contained in the print data.

(1-2) Printer (1-2-1) Units of the Printer

Figure 3:
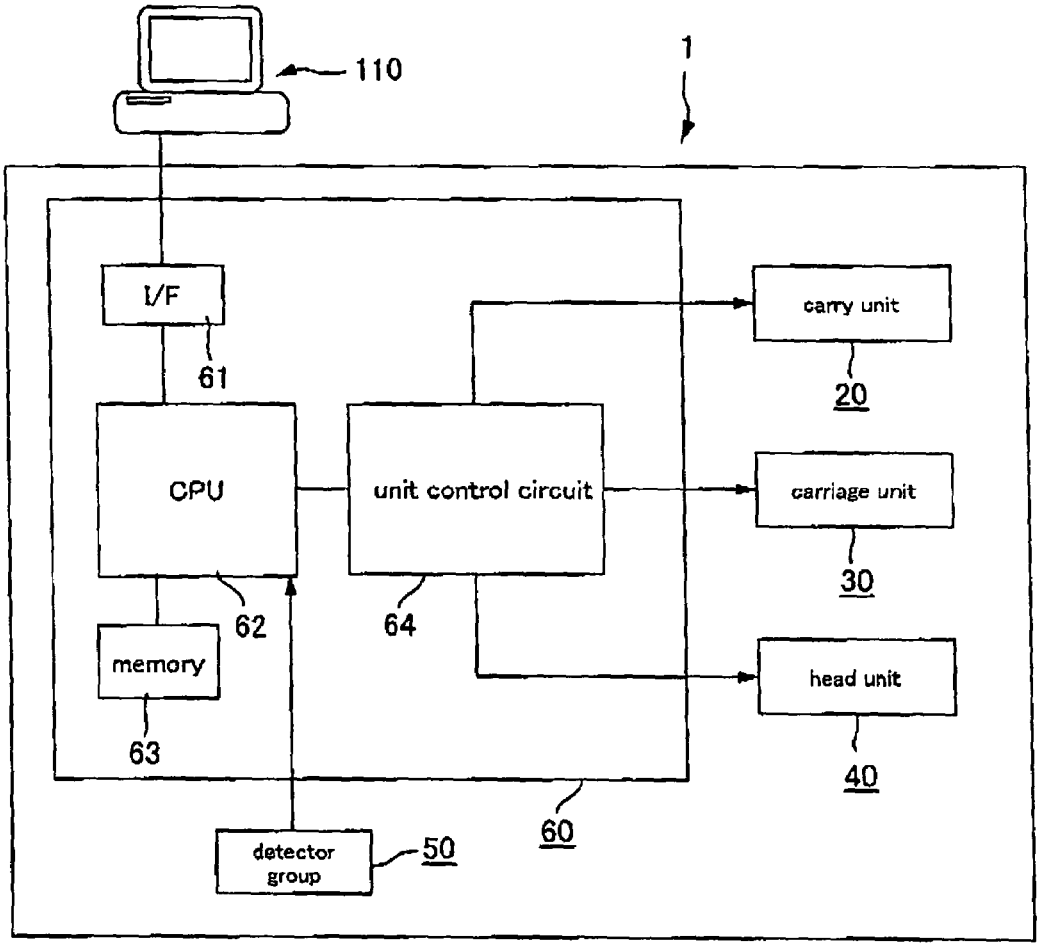
FIG. 3 is a block diagram of the overall configuration of the printer 1.
Figure 4:
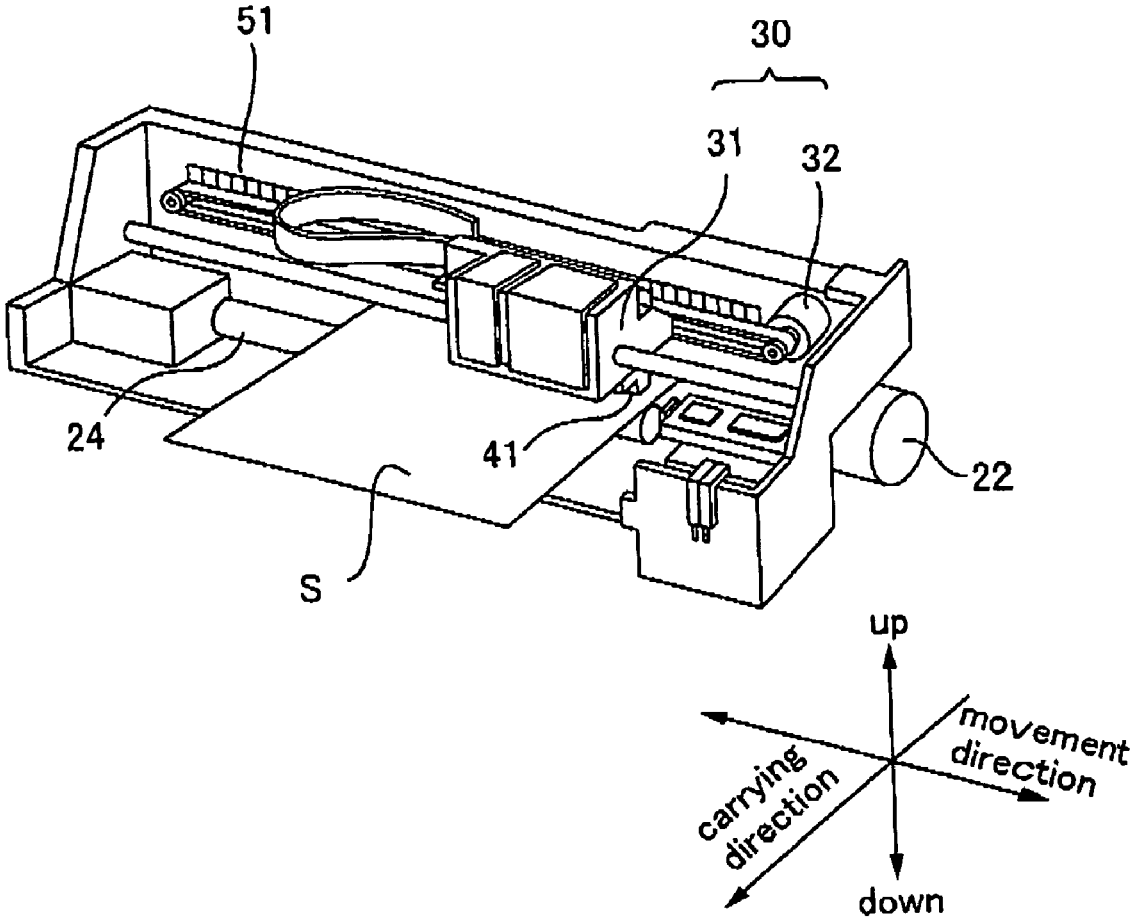
FIG. 4 is a schematic view of the overall configuration of the printer 1.
Figure 5:
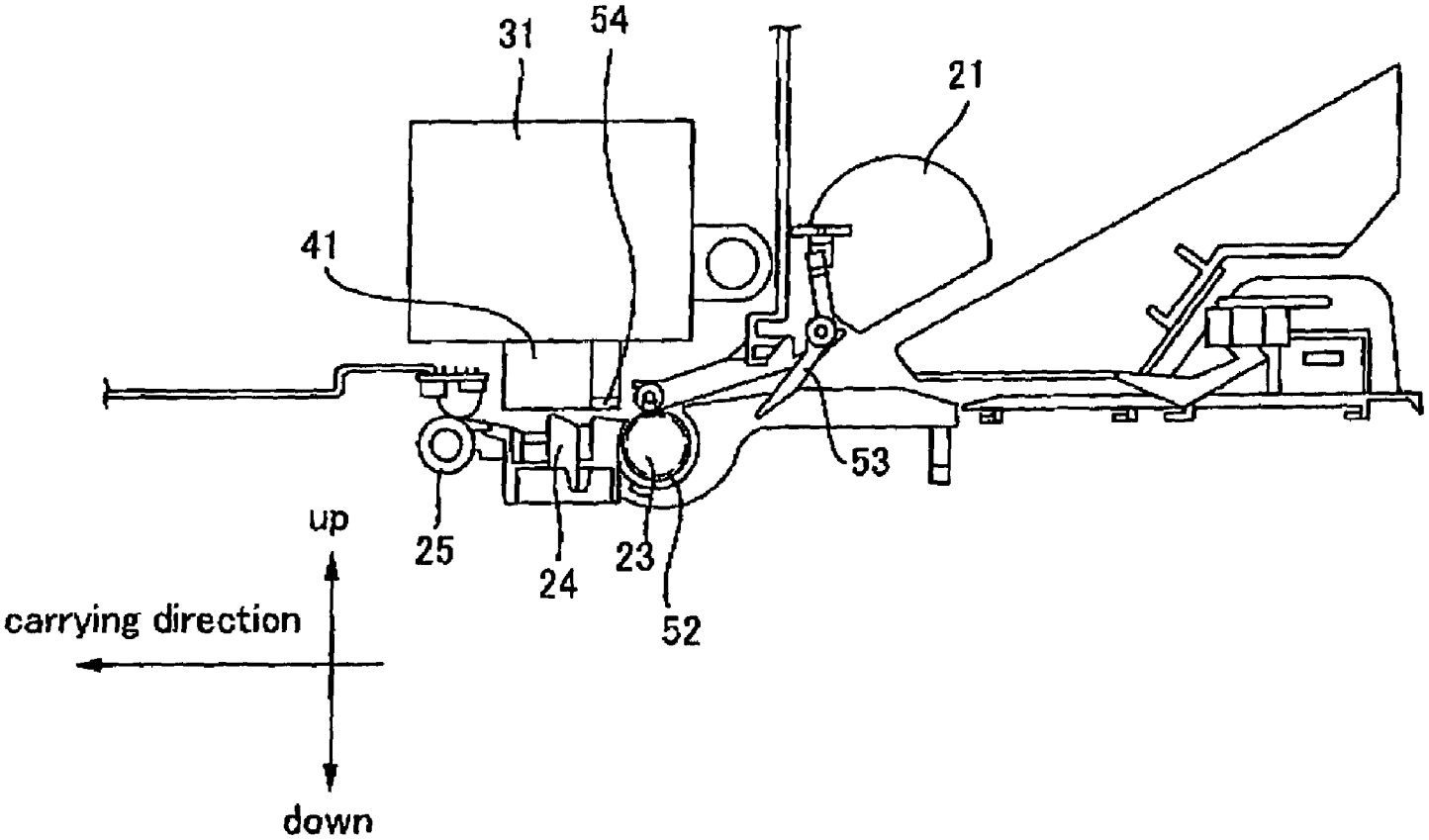
FIG. 5 is a horizontal section of the overall configuration of the printer 1.

FIG. 3 is a block diagram of the overall configuration of the printer 1. FIG. 4 is a schematic view of the overall structure of the printer 1. FIG. 5 is a horizontal section through the overall structure of the printer 1. The basic structure of the printer of this embodiment is described below.

The printer 1 of this embodiment has a carry unit 20, a carriage unit 30, a head unit 40, a detector group 50, and a controller 60. Having received the print data from the computer 110, which is an external device, the printer 1 controls the various units (the carry unit 20, the carriage unit 30, and the head unit 40) using the controller 60. The controller 60 controls the units in accordance with the print data that have been received from the computer 110 to print an image on paper. The detector group 50 monitors the conditions within the printer 1, and outputs the results of this detection to the controller 60. The controller 60 controls each unit based on the detection results that are output from the detector group 50.

The carry unit 20 is for delivering the paper S to a printable position, and carrying the paper S by a predetermined carry amount in a predetermined direction (hereinafter, referred to as the "carrying direction") during printing. In other words, the carry unit 20 functions as a carrying mechanism (carrying means) for carrying paper. The carry unit 20 has a paper supply roller 21, a carry motor 22 (also called the PF motor), a carry roller 23, a platen 24, and a paper discharge roller 25. The paper supply roller 21 is a roller for supplying paper that has been inserted into a paper insert opening into the printer. The carry motor 22 is a motor for carrying the paper in the carrying direction. The carry roller 23 is a roller for carrying the paper S that has been supplied by the paper supply roller 21 up to a printable region, and is driven by the carry motor 22. The platen 24 supports the paper S during printing. The paper discharge roller 25 is a roller for discharging the paper S to outside the printer, and is provided on the carrying direction downstream side of the printable region. The paper discharge roller 25 is rotated in synchronization with the carry roller 23.

The carriage unit 30 is for making the head move (also referred to as "scan") in a predetermined direction (hereinafter, referred to as the "movement direction"). The carriage unit 30 has a carriage 31 and a carriage motor 32 (also referred to as "CR Motor"). The carriage 31 can be moved back and forth in the movement direction. The carriage 31 detachably retains an ink cartridge containing ink. The carriage motor 32 is a motor for moving the carriage 31 in the movement direction.

The head unit 40 is for ejecting ink onto paper. The head unit 40 has a head 41. The head 41 has a plurality of nozzles and intermittently ejects ink from those nozzles. The head 41 is provided on the carriage 31. Thus, when the carriage 31 moves in the movement direction, the head 41 also moves in the movement direction. Dot lines (raster lines) are formed on the paper in the movement direction as a result of the head 41 intermittently ejecting ink while moving in the movement direction.

The detector group 50 includes a linear encoder 51, a rotary encoder 52, a paper detection sensor 53, and an optical sensor 54, for example. The linear encoder 51 is for detecting the position of the carriage 31 in the movement direction. The rotary encoder 52 is for detecting the amount of rotation of the carry roller 23. The paper detection sensor 53 is for detecting the position of the front edge of the paper to be printed. The optical sensor 54 is attached to the carriage 31. The optical sensor 54 detects whether or not the paper is present by its light-receiving section detecting the reflected light of the light that has been irradiated onto the paper from the light-emitting section.

The controller 60 is a control unit (control means) for performing control of the printer. The controller 60 has an interface section 61, a CPU 62, a memory 63, and a unit control circuit 64. The interface section 61 is for exchanging data between the computer 110, which is an external device, and the printer 1. The CPU 62 is a computer processing device for carrying out the overall control of the printer. The memory 63 is for reserving a working area and an area for storing the programs for the CPU 62, for instance, and includes storage means such as a RAM or an EEPROM. The CPU 62 controls the various units via the unit control circuit 64 in accordance with the programs stored on the memory 63.

(1-2-2) Head

Figure 6:
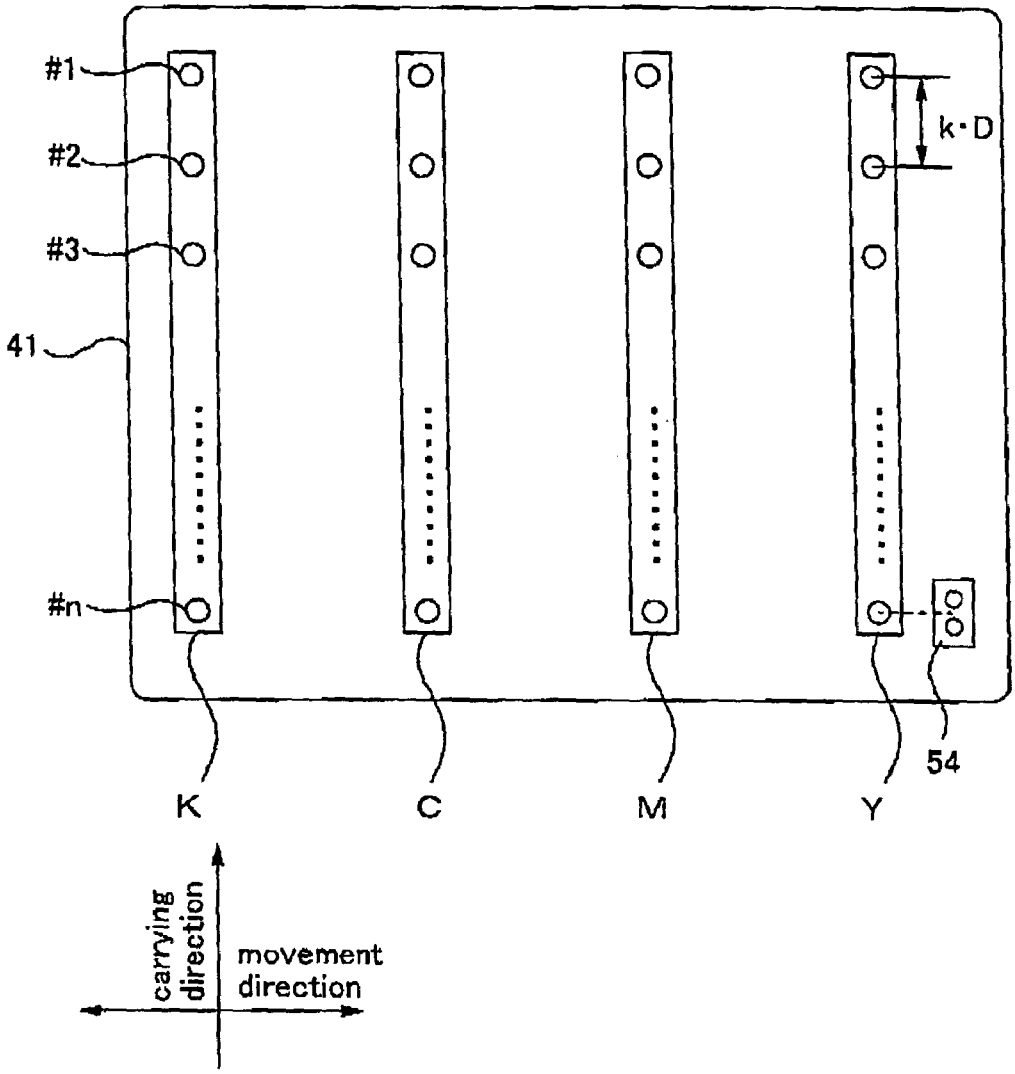
FIG. 6 is an explanatory diagram illustrating the row arrangement of the nozzles in the lower surface of the head 41.

FIG. 6 is an explanatory diagram showing the arrangement of the nozzles in the lower surface of the head 41. A black ink nozzle group K, a cyan ink nozzle group C, a magenta ink nozzle group M, and a yellow ink nozzle group Y are formed in the lower surface of the head 41. Each nozzle group is provided with a plurality of nozzles (in this embodiment, 180), which are ejection openings for ejecting ink of various colors.

The plurality of nozzles in each nozzle group are arranged in a row at a constant spacing (nozzle pitch: k·D) in the carrying direction. Here, D is the minimum dot pitch (that is, the spacing of dots formed on the paper S at the maximum resolution) in the carrying direction. Also, k is an integer of 1 or more. For example, if the nozzle pitch is 180 dpi (1/180 inch) and the dot pitch in the carrying direction is 720 dpi (1/720), then k=4.

The nozzles of each nozzle group are assigned a number (#1 through #180) that becomes smaller the further downstream the nozzle. That is, the nozzle #1 is positioned more downstream in the carrying direction than the nozzle #180. Also, the optical sensor 54 is located substantially at the same position as the nozzle #180, which is on the side furthest upstream, as regards its position in the paper carrying direction.

Each nozzle is provided with an ink chamber (not shown) and a piezo element. Driving the piezo element causes the ink chamber to expand and contract, ejecting an ink droplet from the nozzle.

(1-2-3) Control of the Head

Figure 7:
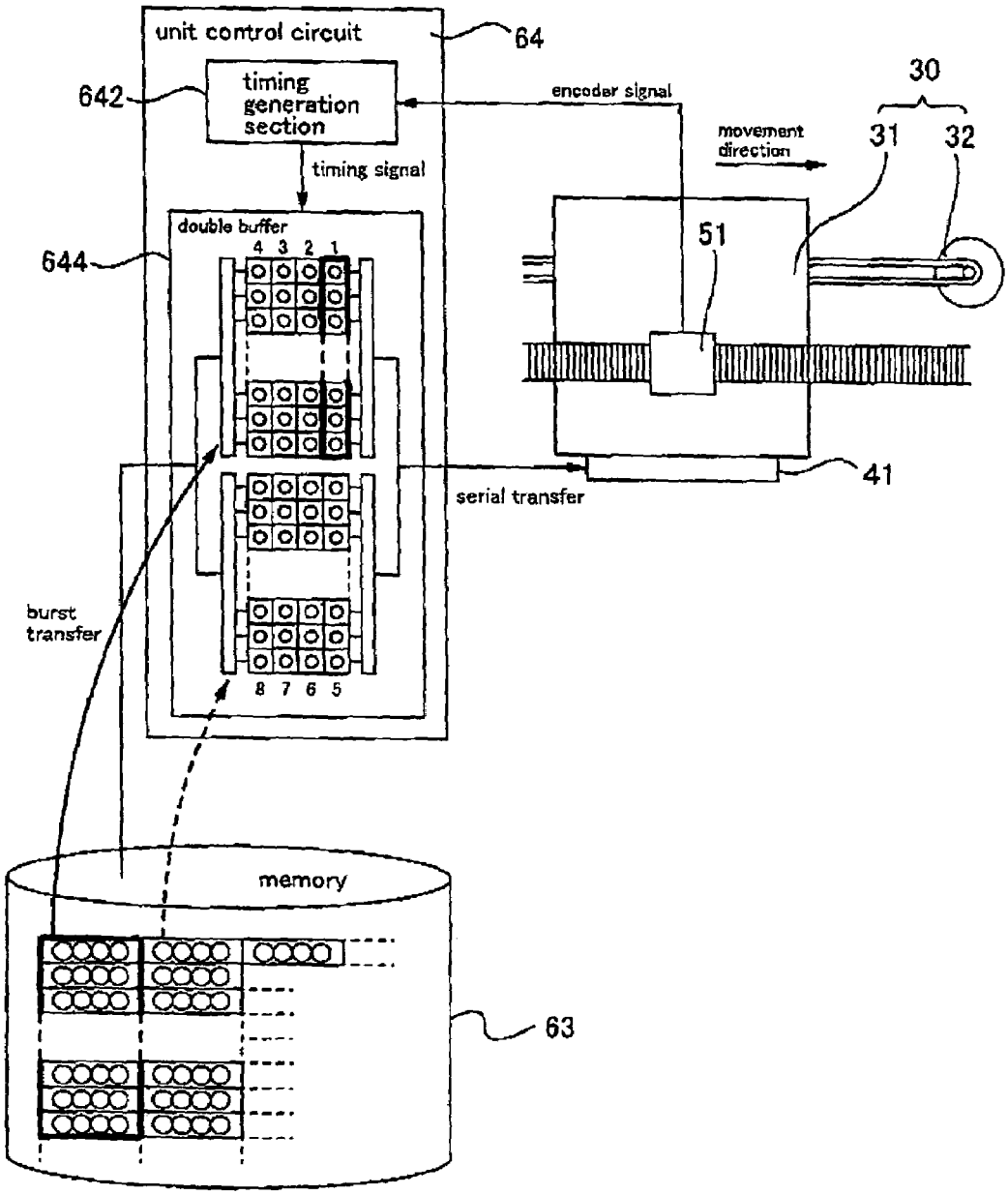
FIG. 7 is an explanatory diagram of how the head is controlled.

FIG. 7 is an explanatory diagram of controlling the head. The unit control circuit 64 has a timing generation section 642 and a double buffer 644. The timing generation section 642 generates timing signals in accordance with the signal from the liner encoder 51 and outputs them to the double buffer 644. The double buffer 644 is provided with two buffers for storing pixel data. Each buffer can store 1 byte of data (pixel data for four pixels) for each nozzle. Each time the double buffer 644 receives a timing signal, the double buffer 644 serially transfers, among the pixel data stored in the buffers, the pixel data for one pixel for all of the nozzles to the head 41.

The operation when the head 41 ejects ink from its nozzles is described below.

First, the printer driver sends the print data to the printer 1. The print data includes a large number of pixel data. The pixel data indicates the dot formation state (large dot, medium dot, small dot, no dot) of a single pixel, and are 2-bits of data each. The pixel data received by the printer 1 have been arranged in an order that is suited for printing (discussed later) due to rasterization by the printer driver, and the printer 1 stores the pixel data in the memory 63 according to that arrangement order. One address in the memory 63 can store one byte of information, so one address contains pixel data for four pixels.

The unit control circuit 64 stores the pixel data that are stored in consecutive addresses of the memory 63 in one of the buffers of the double buffer 644 through burst transfer. It should be noted that adjacent addresses in the memory 63 store pixel data that correspond to adjacent nozzles due to the rasterization performed by the printer driver. Thus, it is possible to burst transfer the pixel data of four pixels for all of the nozzles.

Next, the unit control circuit 64 drives the carriage motor 32 to move the carriage 31,in the movement direction. Each time 35 the carriage 31 moves by 1/180 inch, the linear encoder 51 outputs a pulse signal having one period. The timing generation section 642 generates a timing signal in accordance with the signal from the linear encoder 51.

When the double buffer 644 initially receives the timing signal, it serially transfers the pixel data stored in the first region, which is indicated by the bold line in the drawing, to the head 41. This region stores one pixel of pixel data for all of the nozzles. The head 41 ejects (or does not eject) ink from the nozzles according to these pixel data. Thus, dots are formed in the first pixels on the paper.

The carriage 31 also is moving in the movement direction during the time that ink is ejected from the head 41, and thus the double buffer 644 continues to receive predetermined timing signals. When it receives the next timing signal, the double buffer 644 performs serial transfer of the pixel data stored in the second region to the head 41, and the head 41 ejects ink according to those pixel data. In this way, ink is intermittently ejected from the head 41 in accordance with the timing signal.

When the unit control circuit 64 has finished transmitting pixel data to one of the buffers of the double buffer 644, it transfers the next pixel data to the other buffer from the memory 63. Thus, the double buffer 644 can transfer the pixel data of a fourth region to the head 41 and then can transfer the pixel data of a fifth region in the other buffer to the head 41. Once the unit control circuit 64 has transferred the pixel data of the fourth region to the head 41, it transfers the next pixel data from the memory 63 to the first through fourth regions of the double buffer. In this way, the unit control circuit 64 alternately transfers pixel data to the two buffers of the double buffer 644.

It should be noted that the head 41 is provided with a nozzle group for each color, and that a double buffer 644 is provided for each nozzle group, that is, for each color. However, the timing generation section 642 generates a common timing signal for the plurality of double buffers 644 that are provided for each of the colors. Ink droplets thus are ejected from the various color nozzle groups at a common timing.

(2) Printing Method (2-1) Band Printing (Reference Example)

Figure 8A:
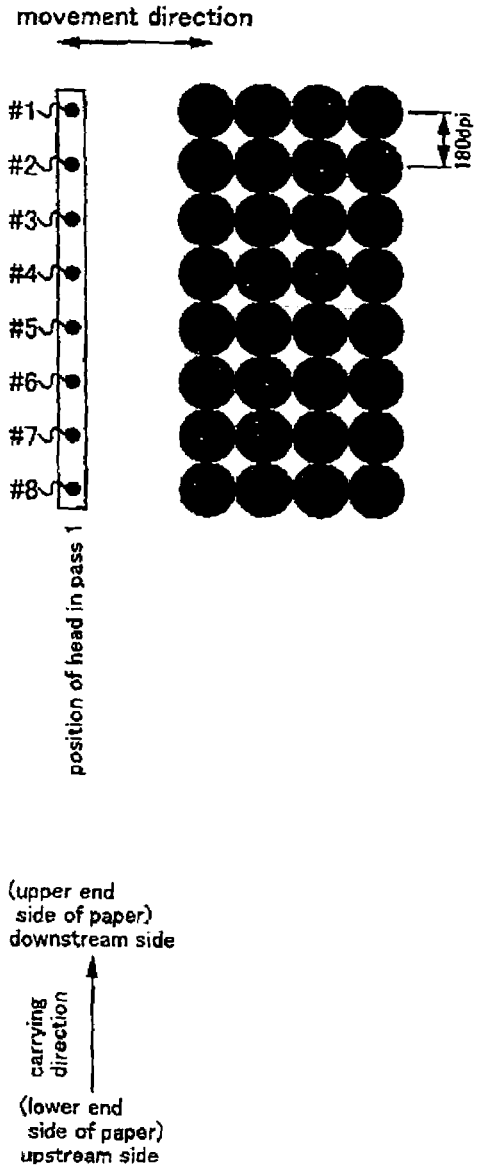
FIG. 8A shows the position of the head (and nozzles) and the manner in which dots are formed in the first pass.
Figure 8B:
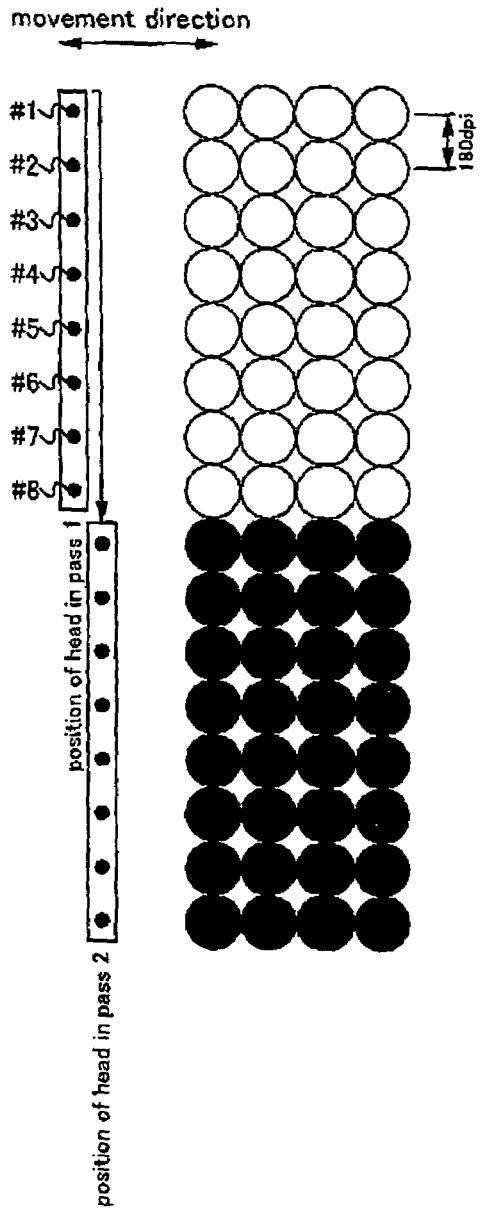
FIG. 8B shows the position of the head and the manner in which dots are formed in the next pass.

FIGS. 8A and 8B are explanatory diagrams of band printing. FIG. 8A shows the position of the head (and nozzles) and how dots are formed in a first pass, and FIG. 8B shows the position of the head and how dots are formed in the next pass.

For the sake of convenience, only one nozzle group of the plurality of nozzle groups that are present is shown, and the number of nozzles in that nozzle group has been reduced (in this case, to eight nozzles). The nozzles shown by black circles in the drawings are nozzles that can eject ink. Again, for the sake of convenience, the head (or nozzle group) is shown moving with respect to the paper; however, the figure shows the relative position between the head and the paper, and in practice it is the paper that moves in the carrying direction. Also for the sake of convenience, the nozzles are shown forming only a few dots (black circles in the drawings), but in practice, ink droplets are ejected intermittently from the nozzles, which move in the movement direction, and thus many dots are lined up in the movement direction. This row of dots is also referred to as a "raster line." The dots indicated by the black circles are dots that are formed in the final pass, and the dots that are indicated by the white circles are dots that are formed in prior passes. It should be noted that "pass" refers to the operation (dot formation operation) of ejecting ink from moving nozzles to form dots. Each pass is performed in alternation with the operation (carrying operation) of carrying the paper in the carrying direction.

What is meant by "band printing" is a printing method in which consecutive raster lines are formed in a single pass. That is, in band printing, an band-like (swath-like) image fragment having a length equal to that of the nozzles is formed in a single pass. The carrying operation that is performed between passes carries the paper by the length of the nozzles. By alternately repeating the passes and the carrying operation, the band-like image fragments are joined together in the carrying direction, forming the print image.

In band printing, the spacing D between dots in the carrying direction is the same as the nozzle pitch, and in this embodiment is 180 dpi.

(2-2) Interlaced Printing (Reference Example)

Figure 9A:
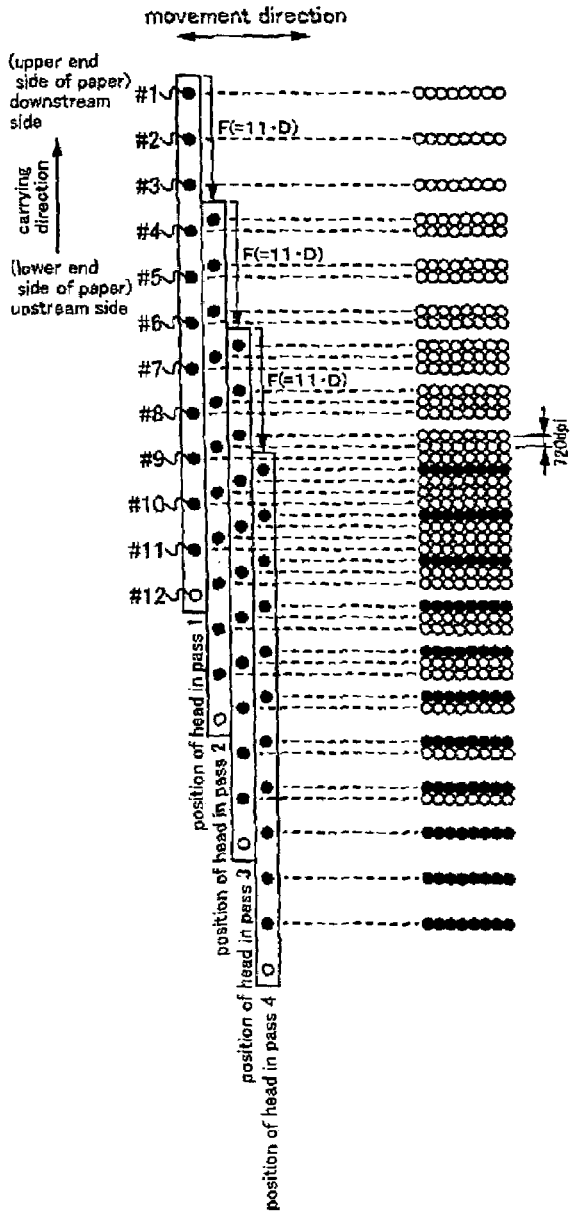
FIGS. 9A and 9B are explanatory diagrams of interlaced printing.
Figure 9B:
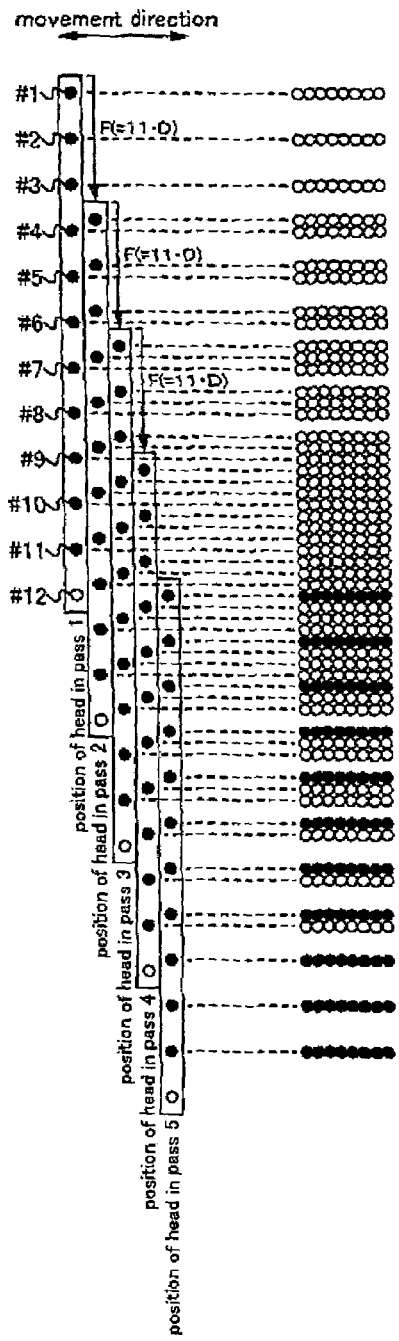

FIGS. 9A and 9B are explanatory diagrams of interlaced printing. FIG. 9A shows the position of the head (or nozzle group) and how dots are formed in pass 1 through pass 4, and FIG. 9B shows the position of the head and how dots are formed in pass 5.

For the sake of convenience, here, the number of nozzles in the nozzle group has been set to 12. It should be noted that the nozzle shown by the white circles in the drawings is a nozzle that cannot eject ink.

"Interlaced printing" is used to mean a printing method in which k is at least 2 and at least one raster line that is not recorded is sandwiched between raster lines that are recorded in a single pass. For example, with the interlaced printing shown in the figure, three raster lines are sandwiched between the raster lines that are formed in a single pass.

In interlaced printing, each time the paper is carried by a constant carry amount F in the carrying direction, the nozzles each record a raster line immediately above the raster lines that were formed in the pass immediately prior. To perform this recording operation while keeping the carry amount constant, it is necessary that (1) the number of nozzles N (integer) that can eject ink is coprime with respect to k, and (2) the carry amount F is set to N·D.

In the interlaced printing shown in the figure, the nozzle group has 12 nozzles arranged in a row in the carrying direction. The nozzle pitch k of the nozzle group is 4; therefore, to satisfy the condition that "N and k are coprime" for performing interlaced printing, not all of the nozzles are used, and in this case, only 11 nozzles (nozzle #1 through nozzle #11) are used. Because 11 nozzles are used, the paper is carried by the carry amount 11·D.

Interlaced printing allows the dot spacing D in the carrying direction to be set smaller than the nozzle pitch, and in this embodiment it is 720 dpi. That is, it is possible to form print images that have higher quality than those formed through the band printing discussed above.

(2-3) Overlapped Printing (2 Passes)

Figure 10A:
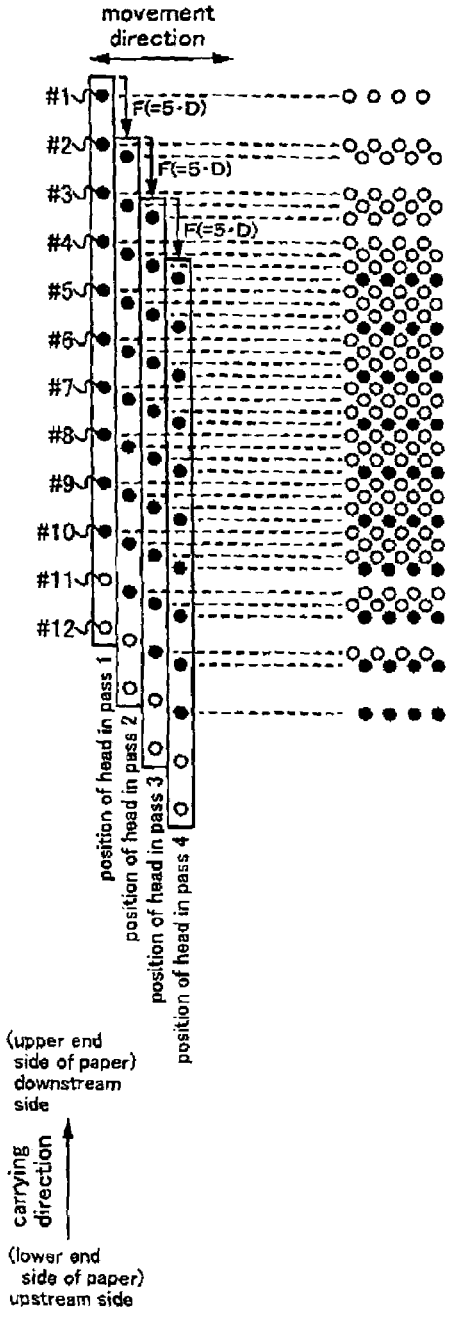
FIGS. 10A and 10B are explanatory diagrams of overlapped printing.
Figure 10B:
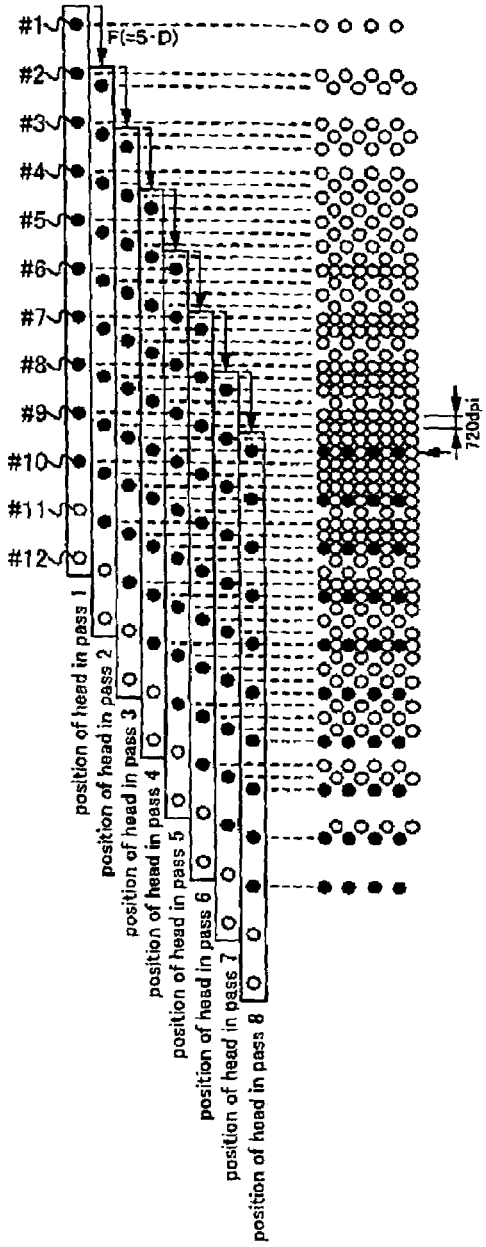

FIGS. 10A and 10B are explanatory diagrams of overlapped printing. FIG. 10A shows the position of the head and how dots are formed in pass 1 through pass 4, and FIG. 10B shows the position of the head and how dots are formed in pass 1 to pass 8.

"Overlapped printing" is used to mean a printing method in which a single raster line is formed by a plurality of nozzles. For example, in the overlapped printing shown in the figure, each raster line is formed by two nozzles.

In overlapped printing, each nozzle forms dots intermittently at an interval of every several dots each time the paper is carried by a fixed carry amount F in the carrying direction. Then, in another pass, dots are formed to complement (fill in the space between) the intermittent dots that have already been formed with another nozzle, and in this way a single raster line is formed by a plurality of nozzles. Forming a single raster line in this manner in M passes is defined as "overlap number M." With the overlapped printing shown in the figure, a single raster line is formed by two nozzles, so the overlap number M is "2".

With overlapped printing, in pass 1 the nozzles form dots in odd-numbered pixels, in pass 2 the nozzles form dots in even-numbered pixels, in pass 3 the nozzles form dots in odd-numbered pixels, and in pass 4 the nozzles form dots in even-numbered pixels. That is, in these first four passes, dots are formed in the order of odd pixel, even pixel, odd pixel, even pixel. Then, in the next four passes (pass 5 through pass 8), dots are formed in the opposite order to the first four passes, in the order of even pixel, odd pixel, even pixel, odd pixel. It should be noted that from pass 9 onward, dots are formed in the same order as in pass 1 and after.

In overlapped printing, to perform this recording operation while keeping the carry amount constant, it is necessary that (1) N/M is an integer, (2) N/M is coprime with respect to k, and (3) the carry amount F is set to (N/M)·D.

In the overlapped printing shown in the figure, the nozzle group has 12 nozzles arranged in a row in the carrying direction. The nozzle pitch k of the nozzle group is 4, however; therefore, to satisfy the condition that "N/M and k are coprime" for performing overlapped printing, it is not possible to use all of the nozzles. Accordingly, of the 12 nozzles, 10 nozzles are used to carry out overlapped printing. Further, since 10 nozzles are used, the paper is carried by the carry amount of 5·D.

Because a single raster line is formed by a plurality of nozzles, overlapped printing allows deterioration in the print image resulting from discrepancies in the dot shape due to the nozzles to be kept from becoming noticeable (in band printing and interlaced printing, a single raster line is formed by the same nozzle, and thus when there are discrepancies in the dot shape due to the nozzles, noticeable stripes (in the movement direction) are formed in the print image). overlapped printing also allows the dot spacing D in the carrying direction to be set smaller than the nozzle pitch, and in this embodiment is 720 dpi. That is, like interlaced printing mentioned above, overlapped printing allows print images that have higher quality than those resulting from the above-mentioned band printing to be formed.

FIGS. 11A and 11B are explanatory diagrams showing how the dots of the raster line indicated by the arrow in FIG. 10B are formed.

FIG. 11A shows how the dots are formed in pass 4, and FIG. 11B shows show the dots are formed in pass 8.

With this raster line, in pass 4 the nozzle #6 intermittently forms dots at a spacing of every other dot, and after several carrying operations and passes have been performed, in pass 8 the nozzle #1 forms dots in a complementary manner to fill in those dots. It should be noted that other raster lines are formed by a different combination of two nozzles (for example, nozzle #7 and nozzle #2).

(2-4) Overlapped Printing (4 Passes)

With the overlapped printing described above, a single raster line is formed by two nozzles. However, it is also possible to form a raster line using more than two nozzles.

Figure 12:
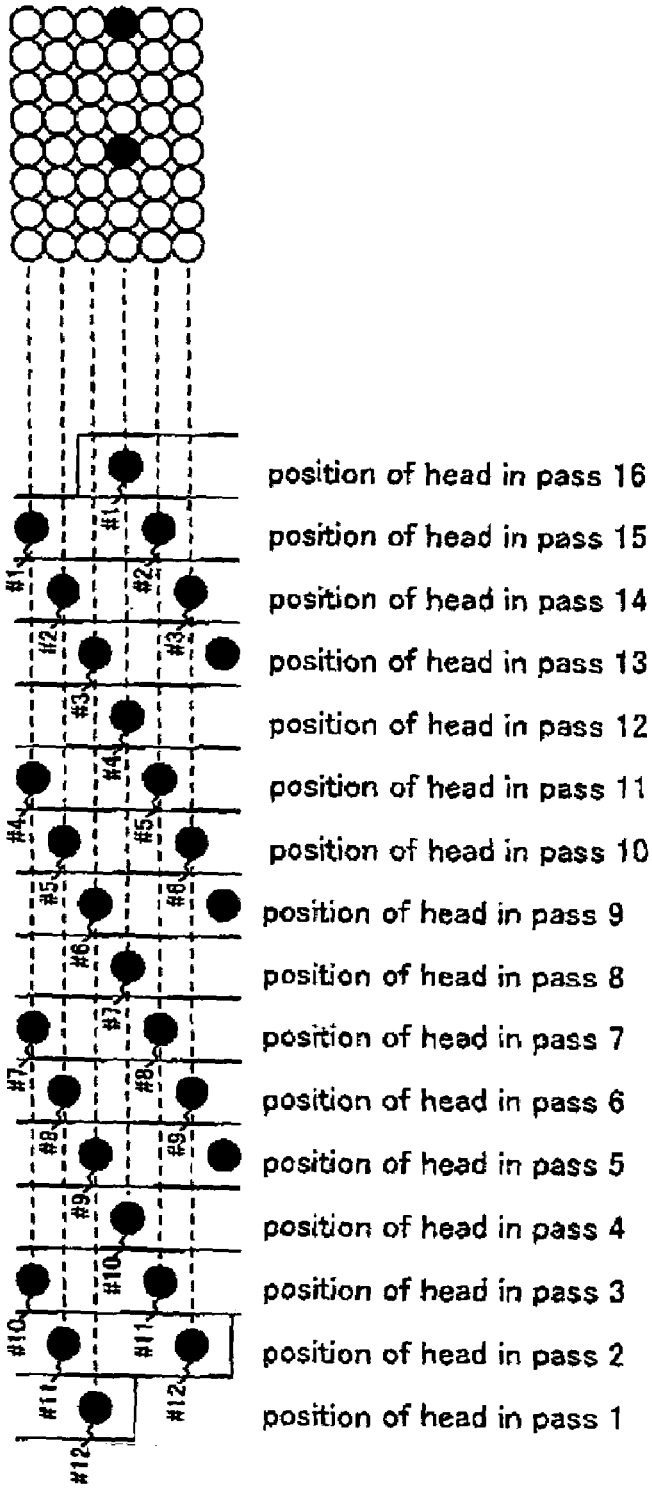
FIG. 12 is an explanatory diagram of overlapped printing in which a single raster line is formed by four nozzles.

FIG. 12 is an explanatory diagram of overlapped printing in which a single raster line is formed by four nozzles. The drawing shows the position of the head and the manner in which dots are formed in passes 1 through 16. For the brevity of description, only a portion of the head is shown.

When forming a single raster line using four nozzles, to satisfy the conditions for overlapped printing, the dot formation operations are performed using all of the nozzles (12 nozzles) and the carrying operations are executed at a carry amount of 3·D. Each nozzle forms a dot every one in four pixels in the dot formation operations.

FIGS. 13A to 13D are explanatory diagrams of how the dots of a particular raster line are formed in a case where a single raster line is formed by four nozzles (M=4).

With this raster line, in pass 4 the nozzle #10 intermittently forms dots leaving a spacing of three pixels between them, in pass 8 the nozzle #7 intermittently forms dots leaving a spacing of three pixels between them, in pass 12 the nozzle #4 intermittently forms dots leaving a spacing of three pixels between them, and in pass 16 the nozzle #1 forms dots in a complementary manner to fill in the remaining pixels. It should be noted that other raster lines are formed by a different combination of four nozzles (such as nozzle #11, nozzle #8, nozzle #5, and nozzle #2).

Figure 14A:
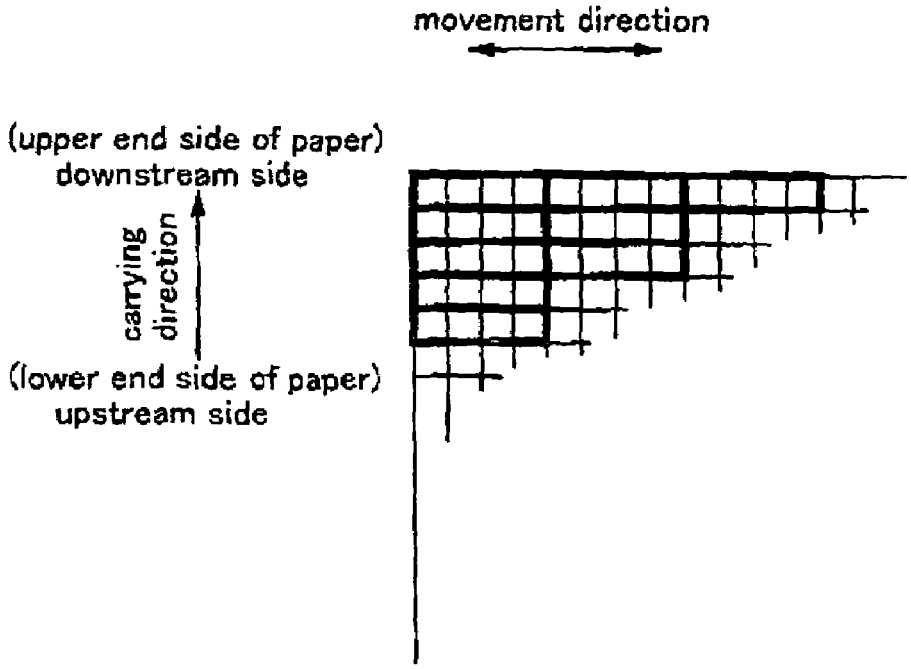
FIG. 14A is an explanatory diagram of the image data after halftone processing.

(3) Methods of Arranging Pixel Data According to the Printing Method (3-1) Arranging the Image Data Before Rasterization FIG. 14A is an explanatory diagram of the image data after halftone processing. The image data after halftone processing are made of 2-bit pixel data for each pixel. Thus, when image data are stored on a memory that stores one byte of information per address, one address will contain the pixel data of four pixels.

Figure 14B:
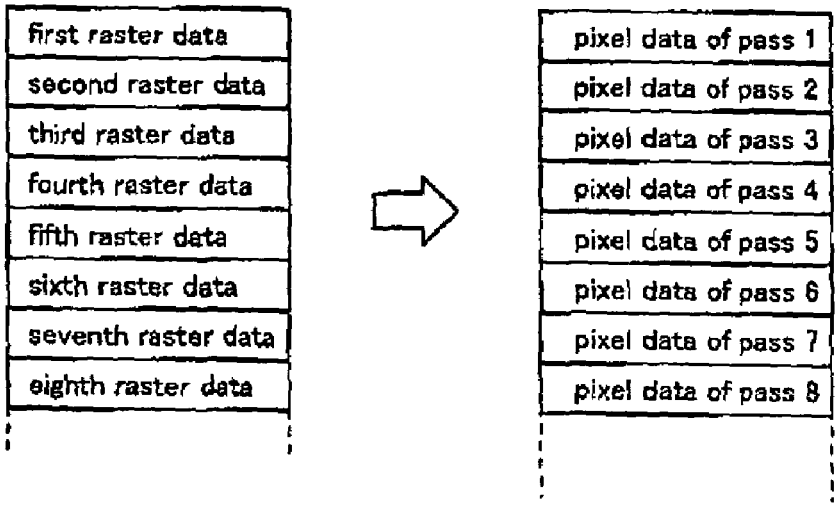
FIG. 14B is an explanatory diagram of the rasterization process.

FIG. 14B is an explanatory diagram of the rasterization process. It should be noted that "raster data" is pixel data that corresponds to a raster line, that is, a plurality of pieces of pixel data that correspond to the plurality of pixels lined up in the movement direction. Further, the "pixel data of pass 1, " for example, are pixel data that are required for pass 1.

The pixel data before rasterization are stored in the memory in the order of the raster lines. That is to say, the pixel data are stored in the order of the raster lines in consecutive addresses of the memory. The pixel data after rasterization are stored in the memory in the order of passes. In other words, the pixel data after rasterization are stored in the memory in the order in which the pixel data are necessary for printing.

However, since the pixel data that are necessary for the passes differ depending on the printing method, the manner in which the pixel data are arranged after rasterization also differs depending on the printing method. Accordingly, the rasterization processes that correspond to the printing methods are described below.

(3-2) In the Case of Band Printing (Reference Example)

Figure 15A:
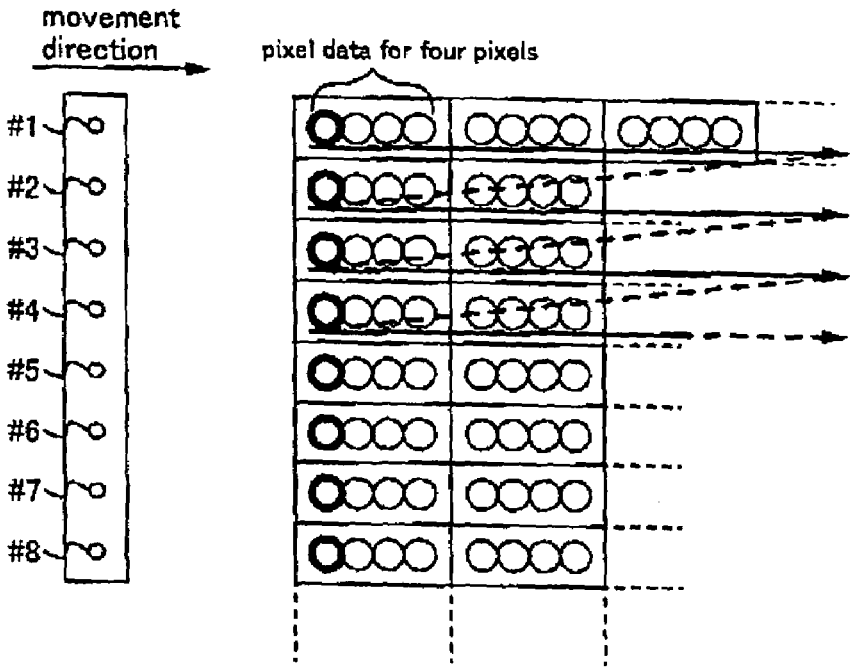
FIG. 15A is an explanatory diagram of how the pixel data are arranged prior to rasterization.
Figure 15B:
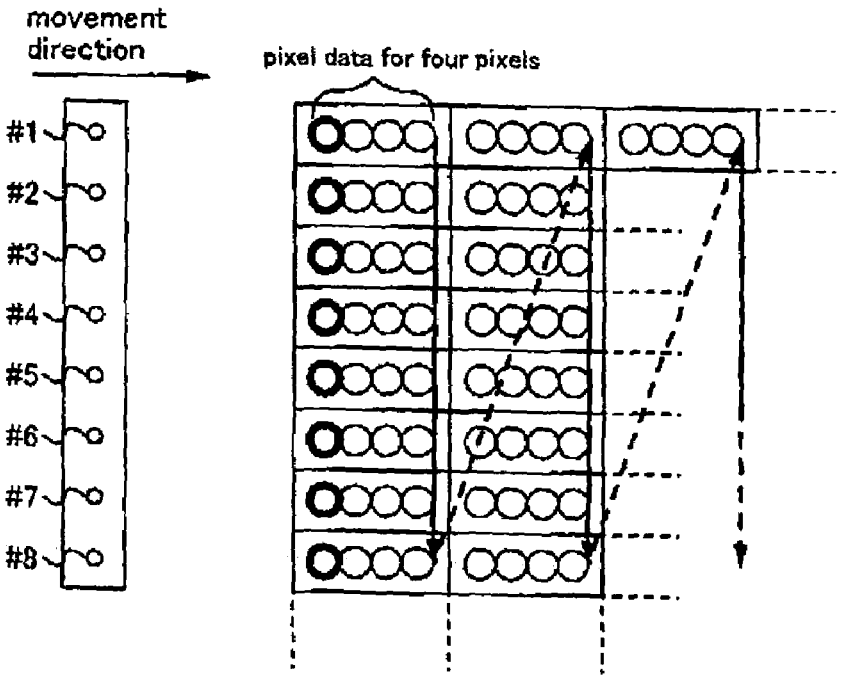
FIG. 15B is an explanatory diagram of how the pixel data are arranged after rasterization in the case of band printing.

FIG. 15A is an explanatory diagram of how the pixel data are arranged before rasterization. FIG. 15B is an explanatory diagram of how the pixel data are arranged after rasterization in the case of band printing. As shown in FIG. 15A, the image data before rasterization are stored in the memory (a memory in the computer) in the order of the raster lines.

If band printing is performed moving the head from left to right as shown in FIG. 15A, the pixel data shown in bold in the drawing first become necessary in order to form a dot in the first pixel. However, the bolded pixel data are not stored in consecutive addresses in the memory. In addition to the pixel data for the initial pixels, the pixel data that become necessary at the same timing when the nozzles #1 to #8 eject ink (for example, the fifth pixel data from the left in each of the first through eighth raster lines) also are not stored in consecutive addresses of the memory.

Accordingly, as the rasterization process for band printing, the printer driver rearranges the pixel data that are arranged as in FIG. 15A to the arrangement shown in FIG. 15B. By doing this, the pixel data shown in bold will be stored in consecutive addresses of the memory. In addition to the pixel data for the initial pixels, the pixel data that become necessary at the same timing when the nozzles #1 to #8 are to eject ink also are stored in consecutive addresses of the memory. Further, the pixel data are rearranged in the order of the pixels in which dots are formed through band printing.

It should be noted that the rearranged pixel data are sent to the printer 1 as print data and stored in the memory 63 of the printer 1 in the same order. Then, by transferring, through burst transfer, the 8 bytes of pixel data in consecutive addresses of the memory 63 to the double buffer 644, the unit control circuit 64 can cause the nozzles to each form the dots for four pixels.

(3-3) In the Case of Interlaced Printing (Reference Example)

Figure 16:
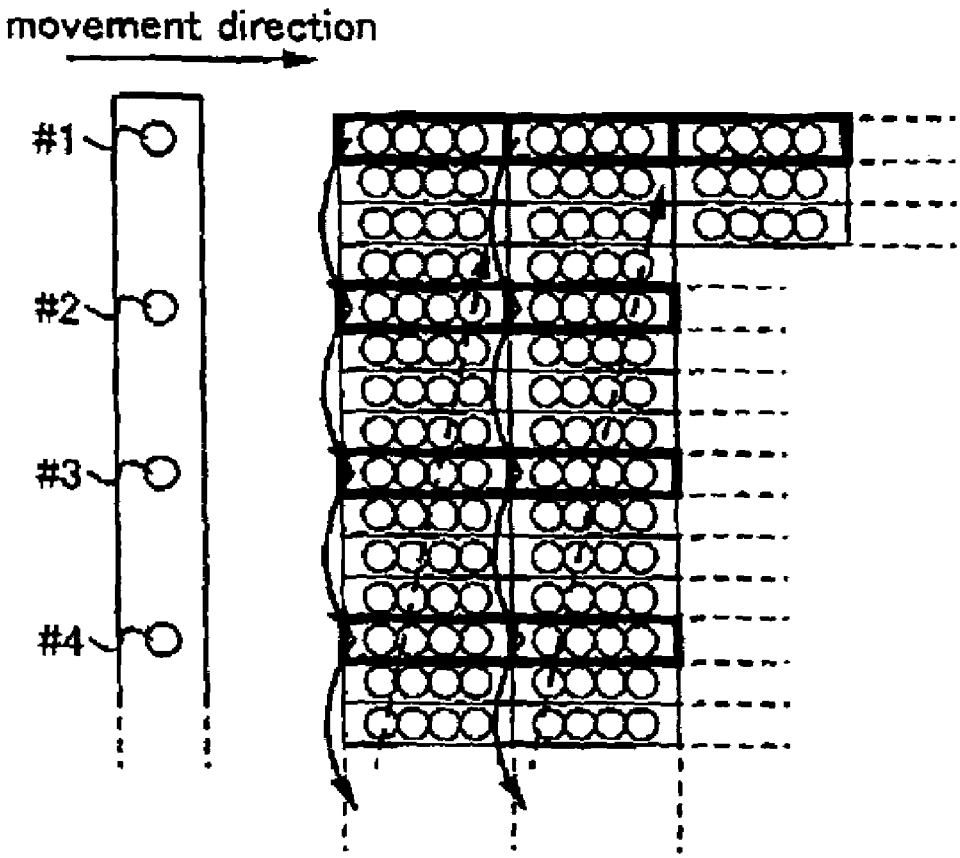
FIG. 16 is an explanatory diagram of the rasterization process in the case of interlaced printing.

FIG. 16 is an explanatory diagram of rasterization in the case of interlaced printing. As in the case of FIG. 15A, the image data before rasterization are stored in the memory in raster line order.

With interlaced printing, at least one raster line that is not recorded is sandwiched between the raster lines that are recorded in one pass. Therefore, the pixel data (raster data) of the raster lines that are formed by the nozzles are rearranged to the order shown in FIG. 16 taking into accounting the association between the nozzle arrangement and the raster lines. Thus, the pixel data are rearranged to the order of pixels in which dots are formed according to interlaced printing.

(3-4) In the Case of Overlapped Printing

Figure 17:
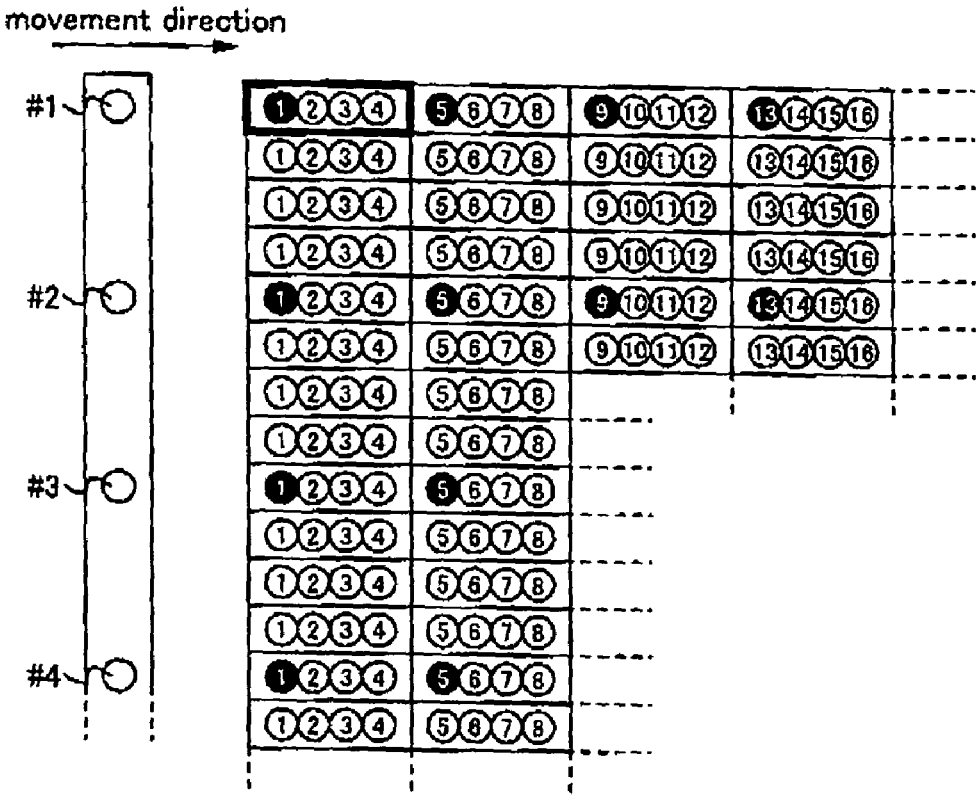
FIG. 17 is an explanatory diagram of the pixel data that are necessary for a certain pass in overlapped printing.

FIG. 17 is an explanatory diagram of the pixel data required for a certain pass in overlapped printing. The discussion here pertains to a case of overlapped printing in which the overlap number M=4 (overlapped printing in which a single raster line is formed by four nozzles). It should be noted that the circles in the drawing show the 2-bit pixel data corresponding to each pixel. The numbers within the circles indicate the positions of the pixels that the pixel data correspond to. The pixel data that are indicated by black circles in the drawing are the pixel data that are required in that pass.

As described earlier, the four pixels of pixel data stored in one address after halftone processing are associated with four pixels that are lined up in the movement direction. In the case of band printing and interlaced printing as discussed above, a single raster line is formed by one nozzle. Therefore, dots are consecutively formed in the four pixels lined up in the movement direction in the same pass, and thus there is no need to rearrange the four pixels of pixel data stored per address after halftone processing, and they can be used as they are after rasterization as well.

With overlapped printing, however, dots are not consecutively formed in the four pixels lined up in the movement direction in the same pass (see FIGS. 13A and 13B). For this reason, only some of the four pixels of pixel data stored in a single address are necessary in a particular pass. For example, if only the #1 pixel data of the four pixels of pixel data, which are shown in bold in the drawing, are necessary, then the pixel in which a dot is formed after the first pixel is the fifth pixel, and thus the second through fourth pixel data stored in the same address as the #1 pixel data are not necessary. Despite this, if print data in which pixel data for the four pixels surrounded by the bold line in the drawing are stored in a single address and sent, then the #2 through #4 pixel data are stored in the double buffer 644 along with the #1 pixel data when the pixel data are burst-transferred from the memory 63 of the printer 1 to the double buffer 644, and as a result, ink droplets corresponding to the #2 through #4 pixel data will be ejected from the head.

For this reason, the processing described below is performed as the rasterization process for overlapped printing.

Figure 18A:
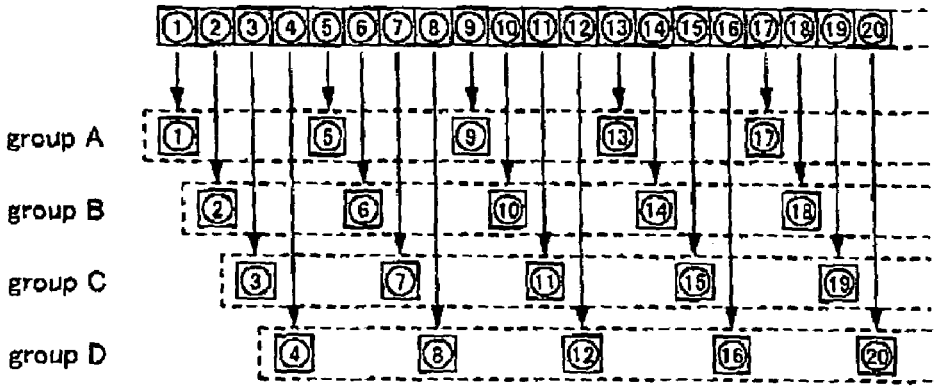
FIG. 18A is an explanatory diagram of the process for dividing the pixel data.

FIG. 18A is an explanatory diagram of the process for dividing (grouping) the pixel data. The drawing shows the pixel data (raster data) of a particular raster line. The printer driver divides the pixel data making up the raster data into four groups (group A through group D). The printer driver divides the pixel data in the order of group A→B→C→D. As a result, when "a" is regarded as the remainder when "n" is divided by 4, then the n-th pixel data is assigned to group A if a=1, to group B if a=2, to group C if a=3, and to group D if a=0.

Figure 18B:
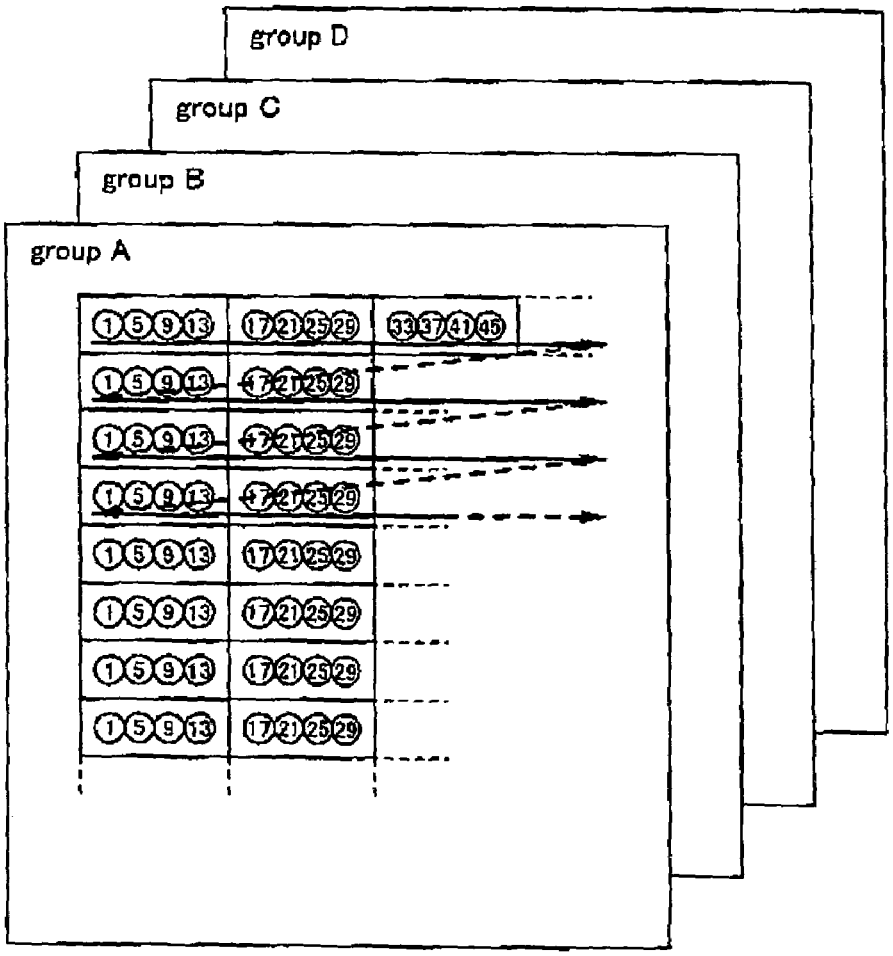
FIG. 18B is an explanatory diagram of the result of the dividing process.

FIG. 18B is an explanatory diagram showing the result of the dividing process. The result of dividing the raster data is that each group is made of raster data in which some pieces of pixel data seem to have been thinned out in the movement direction. In each group, the raster data, in which some pieces of pixel data seem to have been thinned out in the movement direction, are arranged in the order of the raster lines.

FIG. 19A is an explanatory diagram of the order in which the pixel data of pass 4 are arranged. FIG. 19B is an explanatory diagram of the order in which the pixel data of pass 8 are arranged. It should be noted that in pass 4 the nozzle #10, and in pass 8 the nozzle #7, form dots of the same raster line as shown in FIG. 12 and FIGS. 13A through 13D.

With overlapped printing, the pixel data of pass 4 are extracted from group A and the pixel data of pass 8 are extracted from group B It should be noted that, although not shown, the pixel data of pass 12 are extracted from group C and the pixel data of pass 16 are extracted from group D. In this way, in overlapped printing, the group from which the pixel data of each pass are extracted is changed depending on the position of the dots that are to be formed in that pass.

It should be noted that, in consideration of the association between the nozzle arrangement and the raster lines, the process for extracting, from the pixel data of each group, the pixel data of the raster line to be formed by each nozzle is substantially the same as the rasterization process of interlaced printing.

Figure 20:
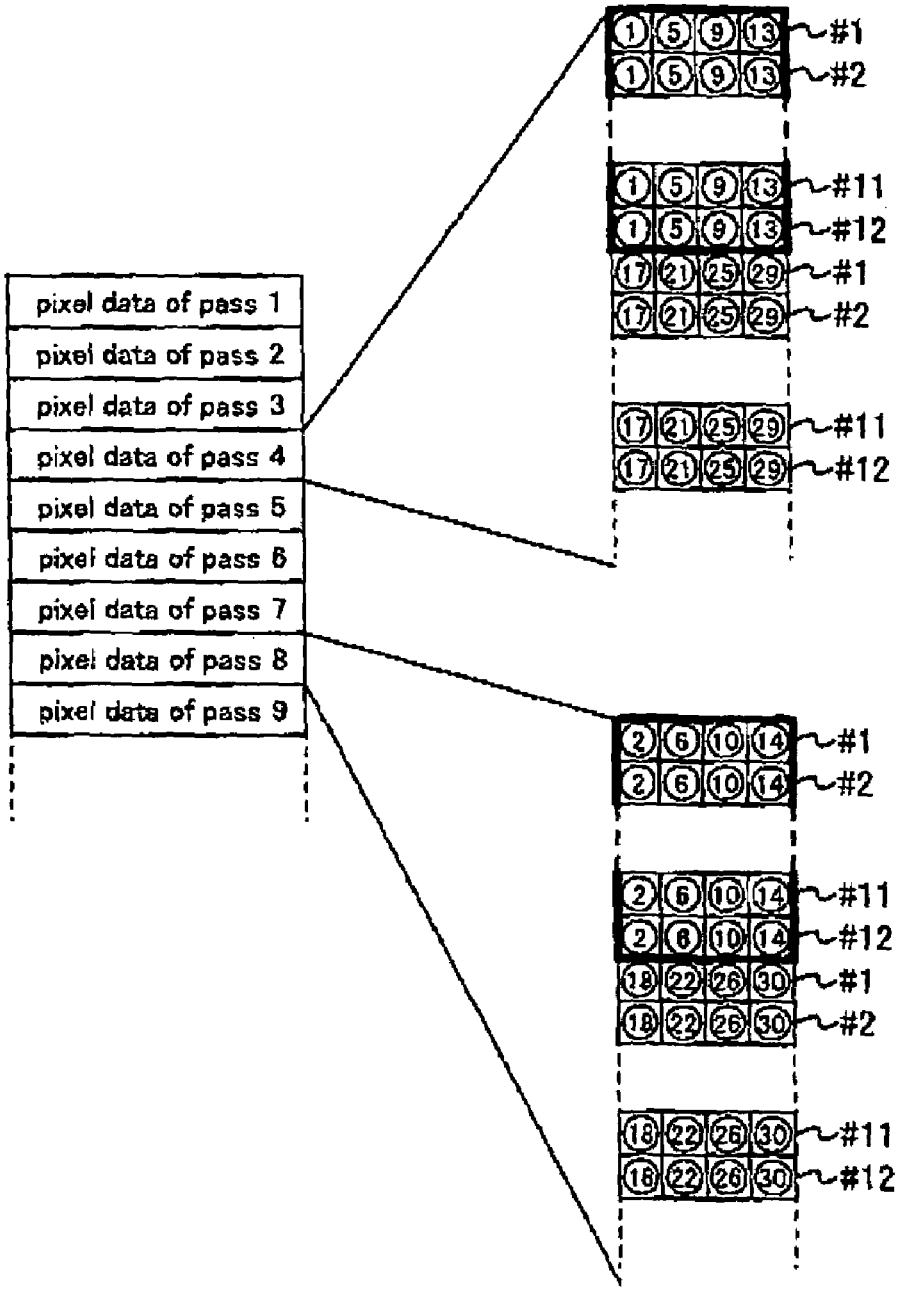
FIG. 20 is an explanatory diagram of the pixel data after rasterization in the case of overlapped printing.

FIG. 20 is an explanatory diagram of the pixel data after rasterization in overlapped printing. The result of rasterization is that the pixel data are rearranged in the order of the passes, and the pixel data for each pass are stored in the memory in the order of the pixel data that are required for printing (see FIG. 20). Here, the initial pixel data (#1 pixel data) of pass 4 and the initial pixel data (#2 pixel data) of pass 8 are stored in the memory in the same manner.

Figure 22:
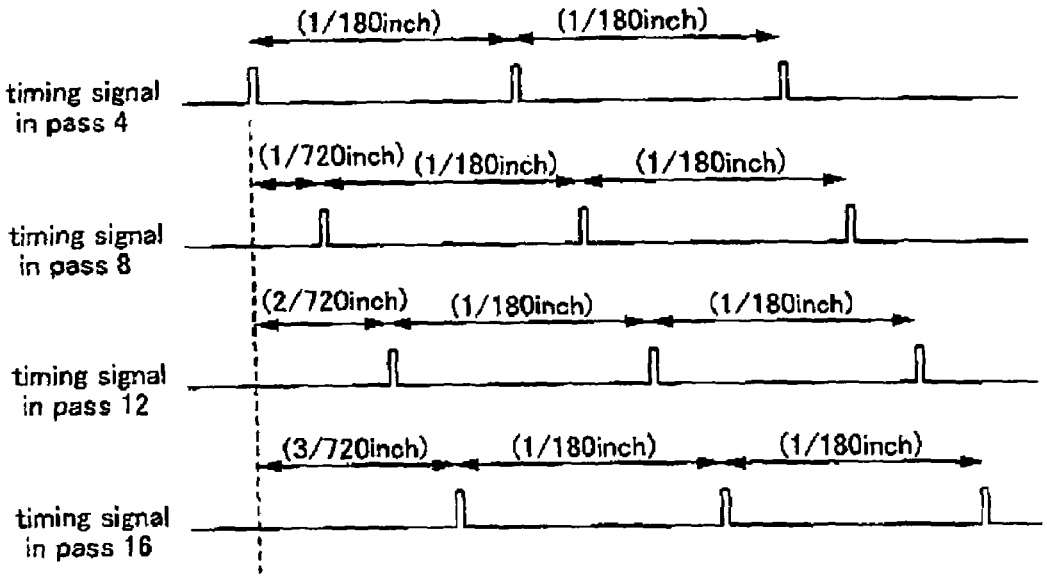
FIG. 22 is an explanatory diagram of the timing signal in each pass.

FIG. 21A is an explanatory diagram of how dots are formed in pass 4. FIG. 21B is an explanatory diagram of how dots are formed in pass 5. FIG. 22 is an explanatory diagram of the timing signal for each of the passes. In overlapped printing, the timing signal that is generated by the timing generation section 642 differs depending on the pass.

As shown in FIG. 22, the timing generation section 642 generates a pulsed signal each time the carriage 31 moves by 1/180 inch. Thus, in each pass, an ink droplet is ejected from the nozzles each time that the carriage 31 has moved by 1/180 inch, forming dots at a spacing of 1/180 inch.

By comparing the pixel data surrounded by a bold line in FIG. 21A and the pixel data that are surrounded by a bold line in FIG. 21B, it can be understood that the initial pixel data (#1 pixel data) stored in the double buffer 644 in pass 4 and the initial pixel data (#2 pixel data) stored in the double buffer 644 in pass 8 are stored similarly. However, as shown in FIG. 22, the timing signal of pass 8 is delayed by 1/720 inch with respect to the timing signal of pass 4. As a result, the position where the initial ink droplet is ejected in pass 8 is 1/720 inch more on the downstream side in the carriage movement direction (on the right side in the figure) than the position where the initial ink droplet is ejected in pass 4. Thus, the first dot formed in pass B is 1/720 inch downstream in the carriage movement direction (right side in the drawings) of the first dot formed in pass 4. That is, the spacing between the dot formed due to the #1 pixel data and the dot formed due to the #2 pixel data becomes 720 dpi. The same applies for the other pixels as well, so that the dots that are formed in pass 8 are 1/720 inch downstream in the carriage movement direction (right side in the drawings) of the dots formed in pass 4.

It should be noted that the dot formed in pass 12, as can be understood from the timing signals in FIG. 22, is 2/720 inch more downstream in the carriage movement direction than the dot formed in pass 4. Further, the dot formed in pass 16 is 3/720 inch more downstream in the carriage movement direction than the dot formed in pass 4. As a result, this raster line is formed by a row of dots at 720 dpi spacing.

(4) Regarding Landing Position Shifting (4-1) Shifting in the Landing Position

The above description assumes that there is no shifting in the positions where the ink droplets land. Thus, in the above description, an ink droplet ejected based on particular pixel data lands correctly in a virtual pixel on the paper that corresponds to that pixel data, forming a dot at the position of that pixel.

In actual printers, however, the flight speed of the ink droplets and the spacing between the nozzles and the paper, for example, are not as expected. This may result in shifting in the positions where the ink lands, leading to dots not being formed where anticipated.

FIG. 23A is an explanatory diagram of how dots are formed under normal conditions. FIG. 23B is an explanatory diagram showing how dots are formed in a case of a slow flight speed In FIG. 23A, an ink droplet is ejected according to the #5 pixel data at a predetermined timing, landing in the fifth pixel on the paper and forming a dot that corresponds to the #5 pixel data in the fifth pixel. On the other hand, in FIG. 23B, an ink droplet is ejected according to the same pixel data at the same timing, but because the flight speed of the ink droplet is slow, it takes time for the ink droplet to land on the paper, and thus a dot is formed more downstream in the carriage movement direction (right side in the drawing) than under normal conditions. Thus, when the flight speed of the ink droplet is slow, the dot that corresponds to the #5 pixel data lands in the sixth pixel on the paper, for example. Dots thus not formed as anticipated may lower the quality of the printed image.

(4-2) Adjusting the Landing Position

FIG. 23C is an explanatory diagram of how the dot formation position has been adjusted. Ejecting an ink droplet that corresponds to the #5 pixel data at a faster timing in this way allows a dot that corresponds to the #5 pixel data to be formed in the fifth pixel on the paper even if the ink droplet flight speed is slow.

How fast (or slow) the timing at which the ink droplet should be ejected is differs among individual printers. The flight speed of the ink droplet is also affected by the viscosity of the ink, which differs depending on the color of the ink.

Accordingly, in this embodiment, an adjustment value table like that shown in FIG. 24 is stored in the memory 63 of the printer 1. The adjustment value table associates an adjustment value with each nozzle group, and is different for each printer because it corresponds to the individual differences unique to that printer. An adjustment value of "−1" indicates that the ink droplet is to be ejected at a timing that is one pixel faster than under normal conditions. An adjustment value of "+1" indicates that the ink droplet is to be ejected at a timing that is one pixel slower than under normal conditions. That is, in the case of FIG. 23C, adjustment is performed based on an adjustment value of "−1."

The manner in which ink droplets are ejected at a timing that corresponds to an adjustment value is described next. To understand the adjustment method of this embodiment, first an adjustment method serving as a reference example is described.

(5) Method of Adjusting the Dot Formation Position (Reference Example)

(5-1) First Reference Example (Band Printing or Interlaced Printing+Pixel Shifting)

JP-A-2000-318145 discloses a method of adjusting the dot formation position by adding dummy pixel data (dummy data) called an "adjustment pixel" to the left and right of the raster data.

Figure 25:
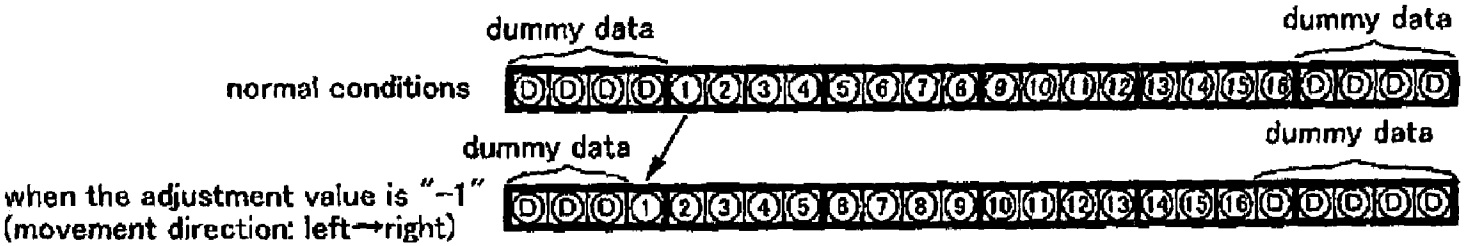
FIG. 25 is an explanatory diagram of the adjustment method of the first reference example.

FIG. 25 is an explanatory diagram of this adjustment method. A predetermined number of dummy data are added to the left and right of the raster data even when the ink droplets are ejected normally. Then, if the adjustment value is "−1," that is, if the ink droplets should be ejected at a timing that is one pixel faster than under normal conditions, then the dummy data on the left side is reduced by one if the carriage movement direction is from left to right (if pixel data are necessary in order from the pixel data on the left side). When ink is ejected based on raster data that have been adjusted in this way, the ink droplets can be ejected at a timing that is one pixel faster than under normal conditions.

However, with this adjustment method, it is necessary for the printer driver to perform a computation process to add or delete one pixel of dummy data when adjusting for a position discrepancy of one pixel. A single address holds the pixel data for four pixels (see the bold lines in the figure), however. Thus, the computational load when adding or deleting four pixels of dummy data is light, but the addition or deletion of one pixel of dummy data places a large computational burden on the printer driver.

(5-2) Second Reference Example (Band Printing or Interlaced Printing+Start Position Change)

FIGS. 26A and 26B are explanatory diagrams of a separate adjustment method. Here, for the sake of comparison and ease of description, both show ink droplets ejected normally.

With the adjustment method of the second reference example, first, as shown in FIG. 25, four pixels (one byte) of dummy data are added to the left and right of the raster data. Four pixels of dummy data also are added, for each nozzle, to the initial pixel data of each pass. It should be noted that there is little computational burden associated with adding four pixels of dummy data.

The pixel data to which dummy data have thus been added are transferred from the memory 63 (not shown) to the double buffer 644, leading to the state shown in FIG. 26A and FIG. 26B.

In this adjustment method, the double buffer 644 is provided with a start position designating section 644A. The start position designating section 644A designates the pixel data to be initially transferred to the head 41. In FIG. 26A, the start position designating section 644A designates the third region, and in FIG. 26B it designates the fourth region.

In FIG. 26A, transfer is begun in order from the pixel data of the third region. The result is that an ink droplet according to the #1 pixel data is ejected after the non-formation of two pixels of dots due to dummy data amounting to two pixels. If the ink droplet is ejected normally, it will land in the first pixel on the paper and form a dot that corresponds to the #1 pixel data in the first pixel.

In FIG. 26B, transfer is performed in order from the pixel data of the fourth region. As a result, an ink droplet due to the #1 pixel data is ejected after the non-formation of one pixel of dots due to one pixel of dummy data. That is, an ink droplet corresponding to the #1 pixel data is ejected in the case of FIG. 26B at a timing that is one pixel faster than in the case of FIG. 26A, and forms a dot corresponding to the #1 pixel data at a position one pixel upstream in the carriage movement direction In a theoretical case where the ink droplet has a slow flight speed and forms a dot that is one pixel downstream in the carriage movement direction (right side in the drawings) of that in the case of normal conditions (see FIG. 23B), adjusting the start position as in FIG. 26B will result in the formation of a dot that corresponds to the #1 pixel data in the first pixel (see FIG. 23C).

(5-3) Comparative Example (Overlapped Printing+Start Position Change)

FIGS. 27A and 27B are explanatory diagrams of a case in which the adjustment method of the second reference example has been adopted for overlapped printing. In FIG. 27A, the start position designating section 644A designates the third region, and in FIG. 27B it designates the fourth region.

As shown in FIG. 22, in overlapped printing, a pulsed timing signal is generated each time the carriage 31 moves by 1/180 inch, and ink droplets are ejected from the nozzles each time the carriage 31 moves by 1/180 inch, forming dots at a 1/180 inch pitch. For this reason, when the region that is designated by the start position designating section 644A is changed from the third region to the fourth region, the dots that are formed are shifted 1/180 inch (four pixels) upstream in the carriage movement direction.

That is, simply adopting the adjustment method of the second reference example in overlapped printing will only allow the positions where dots are formed to be adjusted in 1/180-inch increments.

Accordingly, in the present embodiment, the positions where dots are formed are adjusted in 1/720-inch increments through the adjustment method described below.

(6) Present Embodiment (overlapped Printing+Pass Change)

Figure 28:
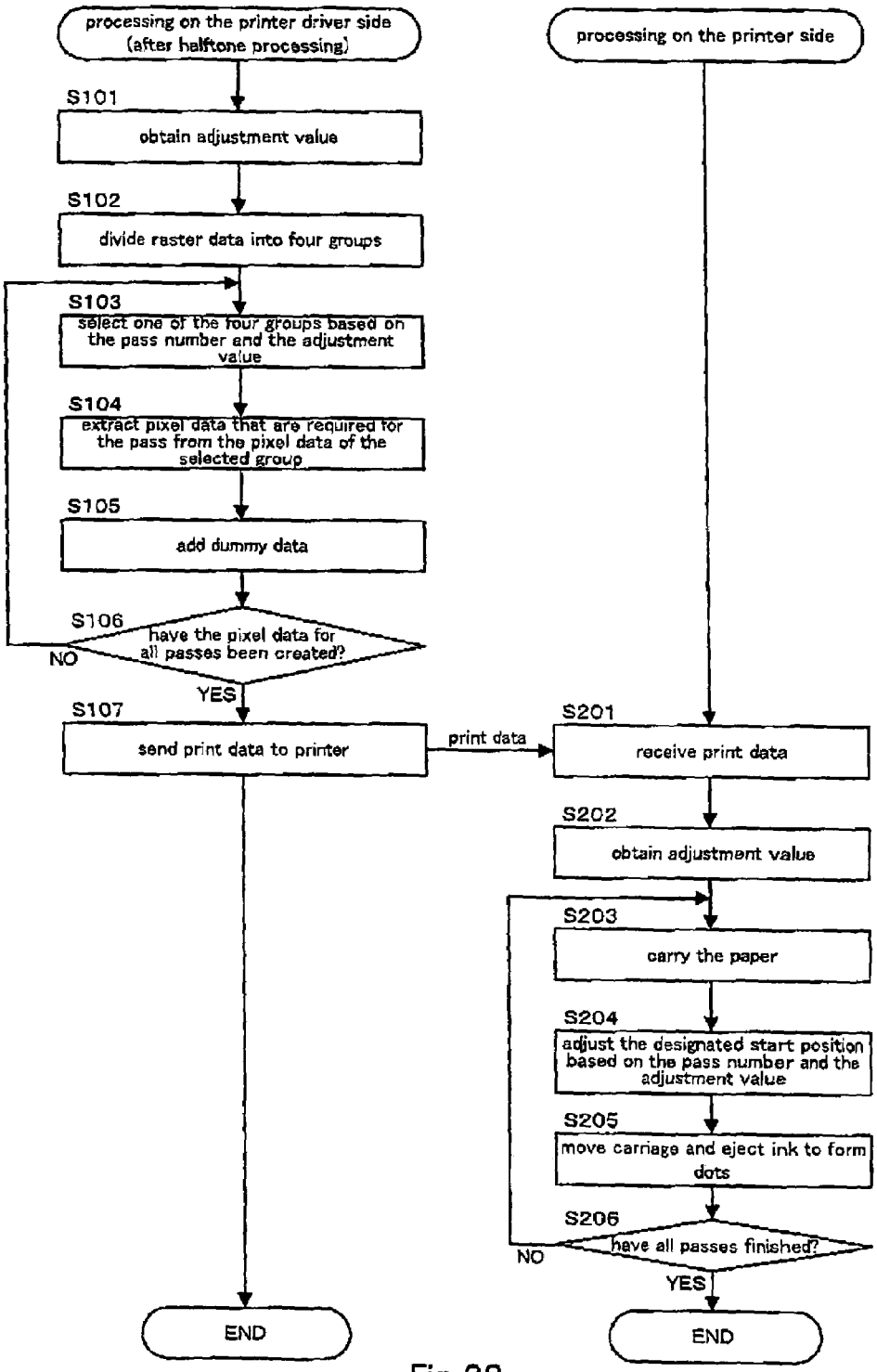
FIG. 28 is a flowchart of the adjustment method of the embodiment.

FIG. 28 is a flowchart of the adjustment method of the present embodiment. The computer 110 performs the processing of steps S101 through S107 in accordance with the printer driver. In other words, the printer driver, which is a program, causes the computer 110 to execute the processing of steps S101 through S107. On the other hand, the controller 60 of the printer 1 performs the processing of steps S201 through S206 in accordance with a program stored in the memory 63.

Figure 29:
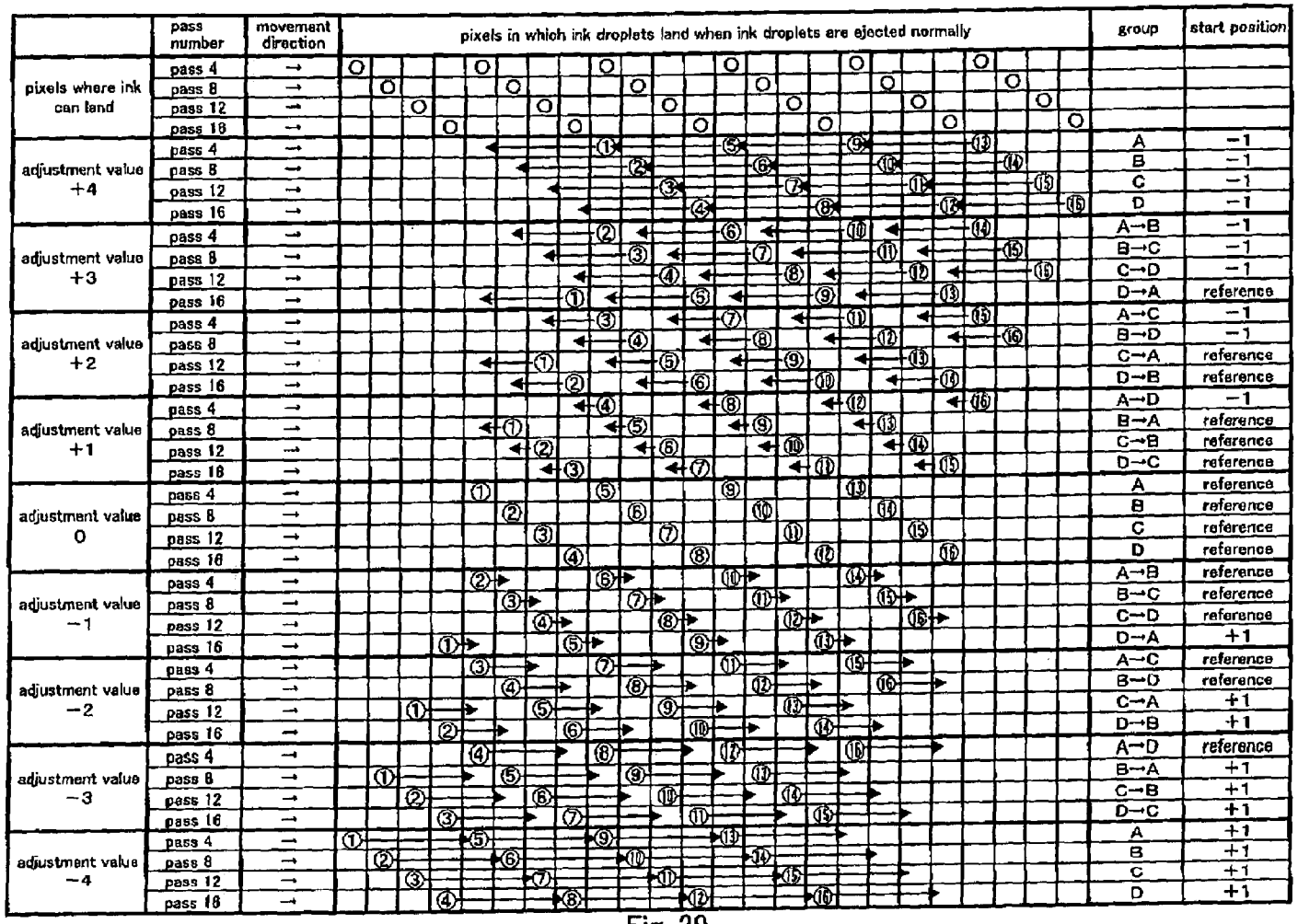
FIG. 29 is an explanatory diagram of the outcome of adjustment in a certain pass.

FIG. 29 is an explanatory diagram of the results of adjusting certain passes. The "movement direction" arrows in the drawing indicate the movement direction of the carriage 31. The grids in the field under the heading "Pixels in which ink droplets land when ink droplets are ejected normally" indicate a spacing of 1/720 inches, that is, a range of one pixel. The circles in the field "Pixels where ink can land" indicate the pixels in which ink droplets can land (pixels in which dots can be formed) if the ink droplets are ejected normally. The circles with numbers in the drawing indicate the number of the pixel data, and the positions of the circles with numbers indicate the pixels where the ink droplets land if the ink droplets are ejected normally. The arrows next to the circles with numbers show the shifting in the positions where the ink droplets land, and the tips of the arrows indicate the pixels in which the ink droplets actually land, taking into account the shifting in the landing positions. The "Group" column in the drawing shows the group from which the pixel data necessary for that pass are to be extracted (see S104 discussed later). For example, in a pass denoted by "A" or "D→A" in the "Group" column, the pixel data are extracted from group A. The column "Start Position" in the drawing shows the start position designated by the start position designating section 644A (see S204 discussed later). For example, in a pass in which "reference" is listed in the "start position" column, the start position designating section 644A designates the third region of the double buffer 644, in a pass where this is "+1" it designates the fourth region, and in a pass where this is "−1" it designates the second region.

It should be noted the meaning of FIG. 29 will become clear by comparing the adjustment value "0" and the adjustment value "−1" in FIG. 29 in the following description. The adjustment method of the present embodiment is described below using FIG. 28 and FIG. 29.

First, the printer driver obtains the adjustment value table stored in the memory 63 of the printer 1 (S101). It should be noted that if the adjustment value table in the memory 63 of the printer 1 is copied to a storage device on the computer 110 side in advance, then it is not necessary for the printer driver to communicate with the printer 1.

The printer driver then divides the pixel data making up each raster data into groups A through D (S102). This process has already been described, and thus will not be described here (see FIGS. 18A and 18B).

The printer driver first selects one of the four groups according to the pass number and the adjustment value (S103). The printer driver then extracts the pixel data that are necessary for that pass from the pixel data of the selected group, taking into consideration the association between the nozzle arrangement and the raster lines (S104). It should be noted that the pixel data necessary for a pass are extracted in substantially the same manner as discussed above, and thus this method will not be described here, and instead the description will focus on which group the pixel data are to be extracted from.

For example, if the adjustment value is "0," then the pixel data of pass 4 are extracted from group A, the pixel data of pass 8 are extracted from group B, the pixel data of pass 12 are extracted from group C, and the pixel data of pass 16 are extracted from group D (see FIGS. 19A, 19B, and 20). In contrast, if the adjustment value is "−1," then the pixel data of pass 4 are extracted from group B, the pixel data of pass 8 are extracted from group C, the pixel data of pass 12 are extracted from group D, and the pixel data of pass 16 are extracted from group A. In this way, the printer driver of this embodiment shifts the order of the groups from which to extract the pixel data according to the adjustment value (see FIG. 29).

Figure 30:
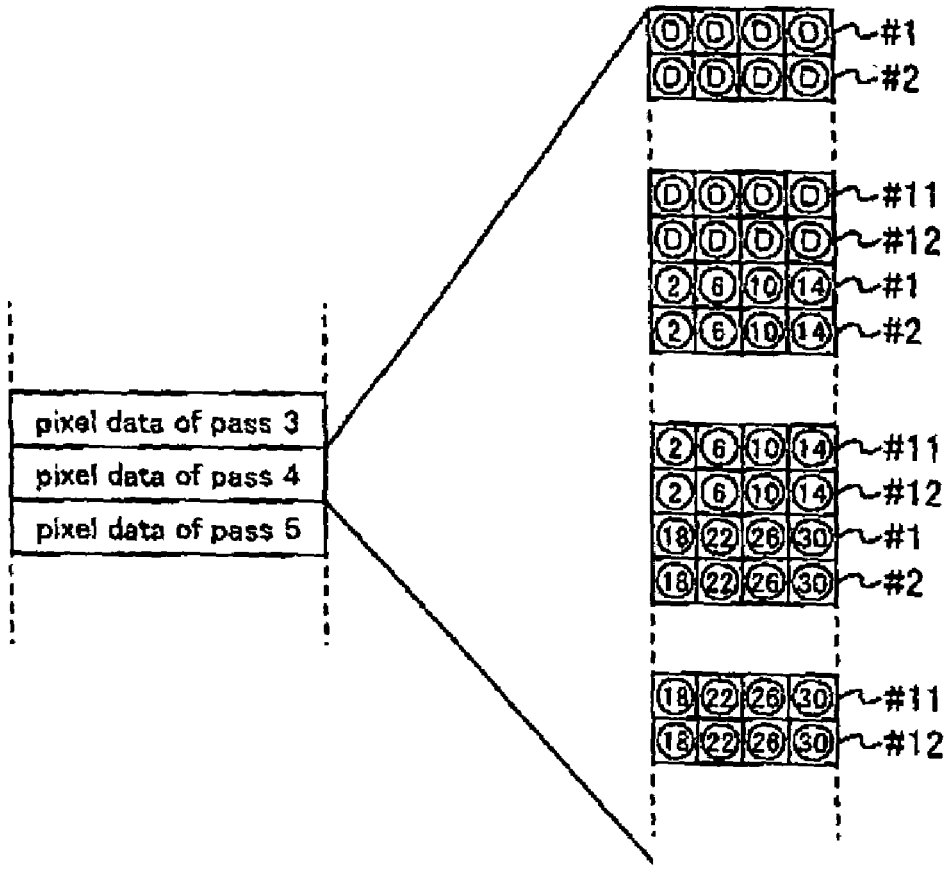
FIG. 30 is an explanatory diagram of the pixel data of pass 4 after dummy data have been added.

Next, the printer driver adds dummy data to the pixel data that have been extracted (S105). FIG. 30 is an explanatory diagram of the pixel data of pass 4 after dummy data have been added in a case where the adjustment value is "−1." Here, four pixels of dummy data are added for each nozzle. It should be noted that adding four pixels of dummy data presents a minimal computational burden. Also, compared to FIG. 20, the pixel data of pass 4 are not the pixel data of group A (the pixel data #1, #5, #9, etc.) but rather the pixel data of group B (the pixel data #2, #6, #10, etc.).

The printer driver performs the procession of the above steps S103 through S105 for all passes. By doing this, the printer driver rearranges the pixel data in an order that is suited for printing, and thus the rasterization process is ended (YES in S106). The printer driver then sends print data that include the rasterized pixel data to the printer 1 (S107).

The controller 60 of the printer 1 receives the print data from the computer 110 and then stores the pixel data that are included in the print data in the memory 63 (5201). The controller 60 then obtains the adjustment value (S202). The adjustment value can be obtained from an adjustment value table that has been stored on the memory 63 of the printer 1 from the beginning, or from the print data if the printer driver has included the adjustment value in the print data. The controller 60 rotates the paper supply roller 21 and the carry roller 23 to feed the paper to the print start position (S203).

The controller 60 then alternately repeats (NO in S206) a dot formation operation (S205) of moving the carriage 31 in the movement direction and causing the nozzles in the head 41, which moves in the movement direction, to eject ink in order to form dots on the paper, and a carrying operation (S203) of carrying the paper in the carrying direction, to print a print image on the paper.

In this embodiment, before the controller 60 starts each pass it causes the start position designating section 644A of the double buffer 644 to adjust the start position according to the pass number and the adjustment value (S204). If the adjustment value is "0," then the start position designating section 644A designates the third region, which is the reference start position, for every pass. In contrast, if the adjustment value is "−1," for example, then the start position designating section 644A designates the third region, which is the reference start position, in passes 4, 8, and 12, and designates the fourth region in pass 16.

FIGS. 31A and 31B are explanatory diagrams of the dot formation process in the case of a "−1" adjustment value Here, the effects of the ink droplet flight speed, for example, have caused the ink droplets to land one pixel downstream in the carriage movement direction of the position where the ink droplet would land normally.

If the ink droplets are ejected correctly in pass 4 as shown in FIG. 31A, then the first ink droplet lands in the first pixel on the paper. However, the effects of the flight speed of the ink droplet will cause the ink droplet ejected at this timing to land in the second pixel on the paper. In this embodiment, however, the pixel data of pass 4 are extracted from group B and an ink droplet that corresponds to the #2 pixel data is ejected first. Thus, in pass 4, a dot that corresponds to the #2 pixel data is formed in the second pixel on the paper. Dots corresponding to the other pixel data (such as the #6 pixel data) also are formed in corresponding pixels on the paper. As in pass 4, dots that correspond to the pixel data are formed in corresponding pixels on the paper in pass 8 and pass 12 as well.

In pass 16 shown in FIG. 31B, if the ink droplets are ejected correctly when the start position is the third region (reference), then the initial ink droplet will land in the fourth pixel on the paper. In the case of a "−1", adjustment value, the start position becomes the fourth region and thus when the ink droplets are ejected correctly, the first ink droplet lands in a pixel that is adjacent left to the first pixel on the paper. However, the effects of the flight speed of the ink droplet will cause the ink droplet that is ejected at this timing instead to land in the first pixel on the paper. In this embodiment, the pixel data for pass 16 are extracted from group A, and thus an ink droplet that corresponds to the #1 pixel data is ejected first. Thus, in pass 16, a dot that corresponds to the #1 pixel data is formed in the first pixel on the paper. Dots corresponding to the other pixel data (such as the #5 pixel data) also are formed in corresponding pixels on the paper.

It should be noted that the above description focuses on the formation of dots in a specific raster line, but the same procedure is performed for the other raster lines as well.

(7) Modified Examples of the Embodiment

The overlapped printing described above requires four passes to form a single raster line. Also, with the above overlapped printing, the carriage 31 moves in the same direction in each of the four passes. In bidirectional printing, however, the movement direction of the carriage 31 will differ depending on the pass.

The following is a description of a case in which the movement direction of the carriage 31 differs depending on the pass.

(7-1) First Modified Example

Figure 32:
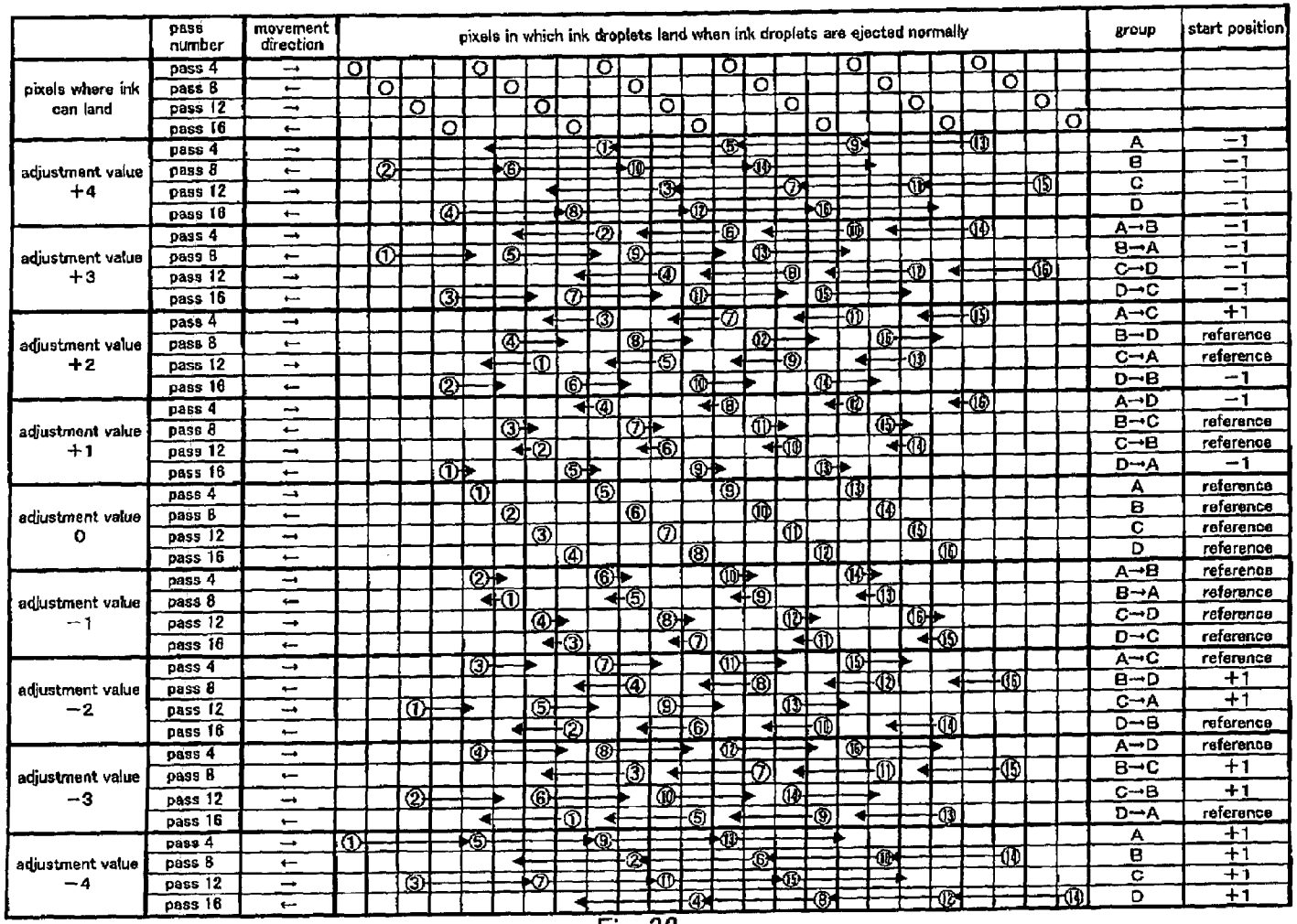
FIG. 32 is an explanatory diagram of a first modified example.

FIG. 32 is an explanatory diagram of a first modified example. In this modified example, the carriage 31 moves from left to right, as in the embodiment described above, in pass 4 and pass 12, but moves from right to left, which is different from the above embodiment, in pass 8 and pass 16.

For example, in a case where the ink droplets land one pixel downstream, in the carriage movement direction, of the positions where ink droplets would land under normal conditions, if the carriage 31 is moving from left to right, the dots are formed to the right (see the arrows under adjustment value "−1" in FIG. 29, and FIG. 23B) However, if the carriage 31 is moving from right to left, then the dots will be formed to the left (see the arrows of pass 8 and pass 16 under adjustment value "−1" heading in FIG. 32).

For this reason, if the ink droplet corresponding to the #3 pixel data is ejected as in the above embodiment at a predetermined timing of pass 8 in which the ink droplet would land in the second pixel on the paper when ink is ejected normally, then that ink droplet will actually land in the first pixel on the paper. That is, at the timing for pass 8, an ink droplet that corresponds to the #1 pixel data, not the #3 pixel data, should be ejected. To put it differently, the pixel data of pass 8 should be selected from group C, not from group A.

Consequently, when the movement direction of the carriage 31 is different depending on the pass, the printer driver selects one of the four groups when executing the step S103 described above, taking into account not only the pass number and the adjustment value but also the movement direction of the carriage 31 (S103). For example, when the adjustment value is "−1," the printer driver selects the pixel data of pass 8 from group C in the case of the above embodiment (see the "Group" column under adjustment value "−1" in FIG. 29), but when the carriage 31 moves from right to left in pass 8 (when moving in the opposite direction), then it selects the pixel data of pass 8 from group A. Similarly, the printer driver selects the pixel data of pass 16 from group C instead of from group A.

Figure 33:
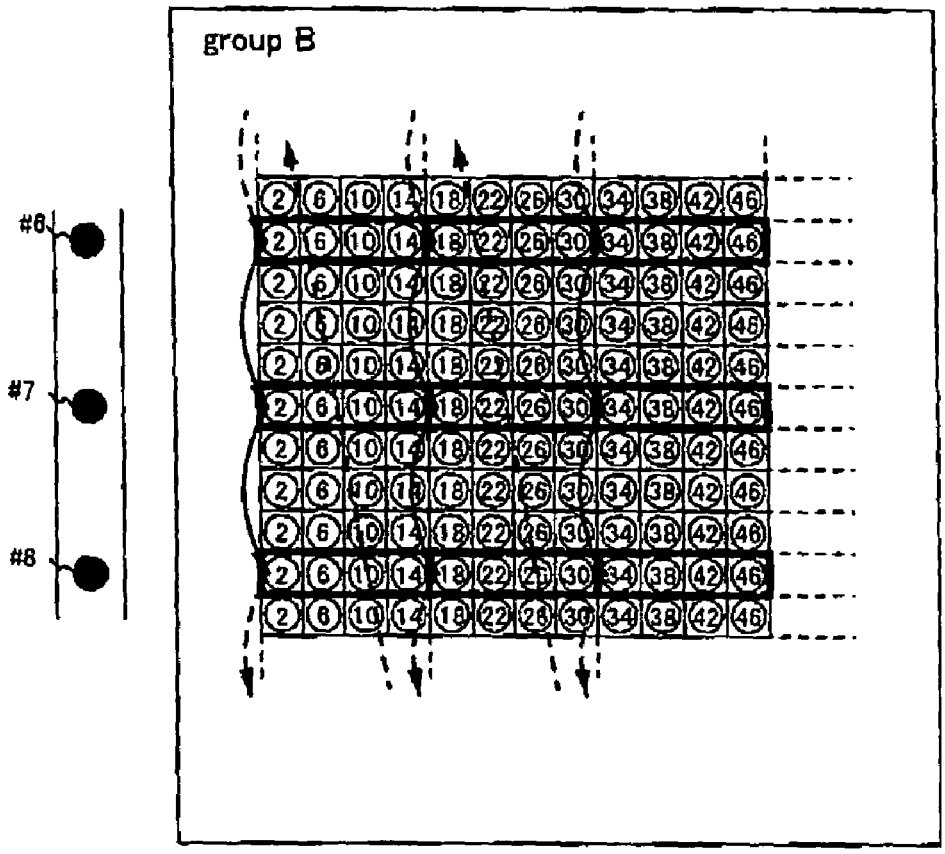
FIG. 33 is an explanatory diagram of how the pixel data are rearranged when bidirectional printing is performed.

It should be noted that during rasterization, the pixel data are rearranged in the order of the pixels in which dots are to be formed. Thus, the pixel data are rearranged so that, of the pixel data for pass 4 for example, the pixel data corresponding to the pixels positioned on the left side of the paper come before the pixel data that correspond to the pixels positioned on the right side of the paper (like in FIG. 19B). However, because the carriage 31 moves in the opposite direction in passes 8 and 16, the pixel data of the passes 8 and 16 are rearranged so that the pixel data corresponding to the pixels positioned on the right side of the paper come before the pixel data that correspond to the pixels positioned on the left side of the paper (see FIG. 33). Then, when the pixel data of pass 8 are held in the double buffer 644, the pixel data corresponding to the pixel on the right side of the paper is transferred to the head 41. The process of rearranging the pixel data for the forward path (when the carriage 31 moves from left to right) and the return path (when the carriage 31 moves from right to left) in bidirectional printing is carried out normally, and thus will not be described here.

Also, when the controller 60 of the printer 1 executes the foregoing step S204, it causes the start position designating section 644A of the double buffer 644 to adjust the start position taking into account not only the pass number and the adjustment value but also the movement direction of the carriage 31 (S204). For example, if the adjustment value is "−1," then, in the case of the foregoing embodiment, the pass 16 start position is the fourth region (see "+1" in the "Start Position" column under the adjustment value "−1" in FIG. 29), but if the carriage 31 moves from right to left in pass 16, then the start position becomes the third region.

(7-2) Second Modified Example

Figure 34:
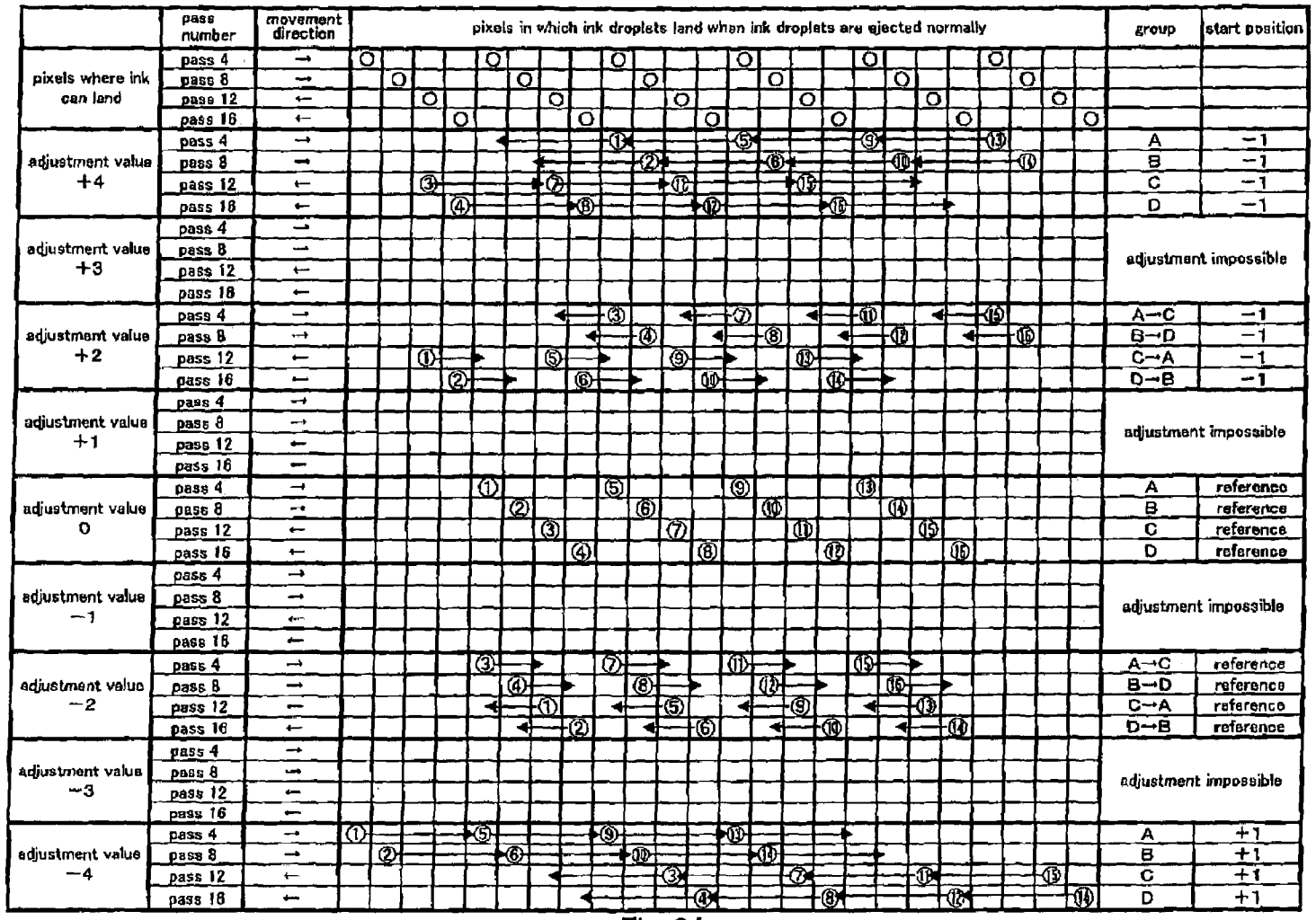
FIG. 34 is an explanatory diagram of a second modified example.

FIG. 34 is an explanatory diagram of a second modified example. In this modified example the carriage 31 movement direction is from left to right in passes 4 and 8 and from right to left in passes 12 and 16. That is, the movement direction of the carriage 31 in passes 8 and 12 is opposite from that in the first modified example.

In this modified example, if the adjustment value is "+3," "+1," "−1," or "−3," then the printer driver and the printer 1 cannot finely adjust the positions where the ink droplets land. The reason for this will be described using an example in which the adjustment value is "−1" (a case in which the ink droplets land one pixel downstream in the carriage movement direction of the positions where they land normally).

In pass 4, the carriage 31 moves from left to right. If the ink droplets are ejected normally, then in pass 4 dots can be formed in the pixels illustrated by the circles in the "Pass 4" row under the "Pixels Where Dots Can Land" heading of FIG. 34. However, when the adjustment value is "−1," the dots are formed one pixel to the right with respect to the positions where ink droplets land under normal conditions. That is to say, the dots that are formed in pass 4 are formed where dots would be formed in pass 8 when the ink droplets are ejected normally. Similarly, the dots that are formed in pass 8 are formed where dots would be formed in pass 12 if the ink droplets are ejected normally.

On the other hand, in pass 12 the carriage 31 moves from right to left. In a situation where the ink droplets are ejected normally, in pass 12 it is possible to form dots in the pixels indicated by the circles in the "Pass 12" row under the "Pixels Where Dots Can Land" heading of FIG. 34. However, when the adjustment value is "−1," the dots are formed one pixel to the left of the positions where the ink droplets would land normally. That is to say, the dots that are formed in pass 12 are formed where dots would be formed in pass 8 when the ink droplets are ejected normally. Similarly, the dots that are formed in pass 16 are formed where dots would be formed in pass 12 when the ink droplets are ejected normally.

For this reason, in either pass, it is not possible to form dots in the positions where dots are to be formed in pass 4 and in pass 16 when the ink droplets are ejected normally. That is, in the case of a "−1" adjustment value, it is not possible to form dots in the pixels indicated by the circles in the "Pass 4" and "Pass 16" rows under the "Pixels Where Dots Can Land" heading of FIG. 34. Thus, the printer driver and the printer 1 cannot perform the fine adjustment that corresponds to the adjustment value if the adjustment value is "−1."

Specifically, adjustment is not possible under the following conditions. The first condition is bidirectional printing. A state in which adjustment is not possible does not occur in the case of unidirectional printing (see FIG. 29). However, there are situations, such as the case of the first modified example, in which adjustment will remain possible even if bidirectional printing is performed. In other words, in addition to bidirectional printing, the next condition also is necessary. The second condition is that the adjustment value is "n," in a case where, when the adjustment value is "0," two pieces of pixel data corresponding to two pixels that are separated by 2×n pixels (where n is an integer) are assigned to passes in which the carriage is moving in the opposite direction.

In the above embodiment (see FIG. 29), the first condition is not met. The first modified example described above (see FIG. 32) meets the first condition; however, when the adjustment value is "0," two pieces of pixel data corresponding to two pixels that are separated by an even number of pixels are assigned to passes in which the carriage moves in the same direction, and thus the second condition is not satisfied. On the other hand, in the second modified example (see FIG. 34), when the adjustment value is "0," the #1 pixel data and the #3 pixel data, for example, correspond to two pixels that are separated by two pixels, the #1 pixel data is assigned to pass 4 in which the nozzles are moved from left to right, and the #3 pixel data is assigned to pass 12 in which the nozzles are moved right to left. For this reason, adjustment is not possible in the second modified example when the adjustment value is "−1."

When adjustment is not possible, it is possible for the printer driver and the printer 1 to not perform the adjustment that is associated with the adjustment value (that is, to perform the processing that corresponds to an adjustment value of "0"). However, if the adjustment value is "−3," then not performing adjustment will result in a large shift in the positions where dots land, and this will significantly lower the image quality. Thus, the printer driver and the printer 1 can perform adjustment that corresponds to the adjustment value nearest to the "−3" adjustment value (such as the adjustment value "−2" or "−4").

(7-3) Third Modified Example

Figure 35:
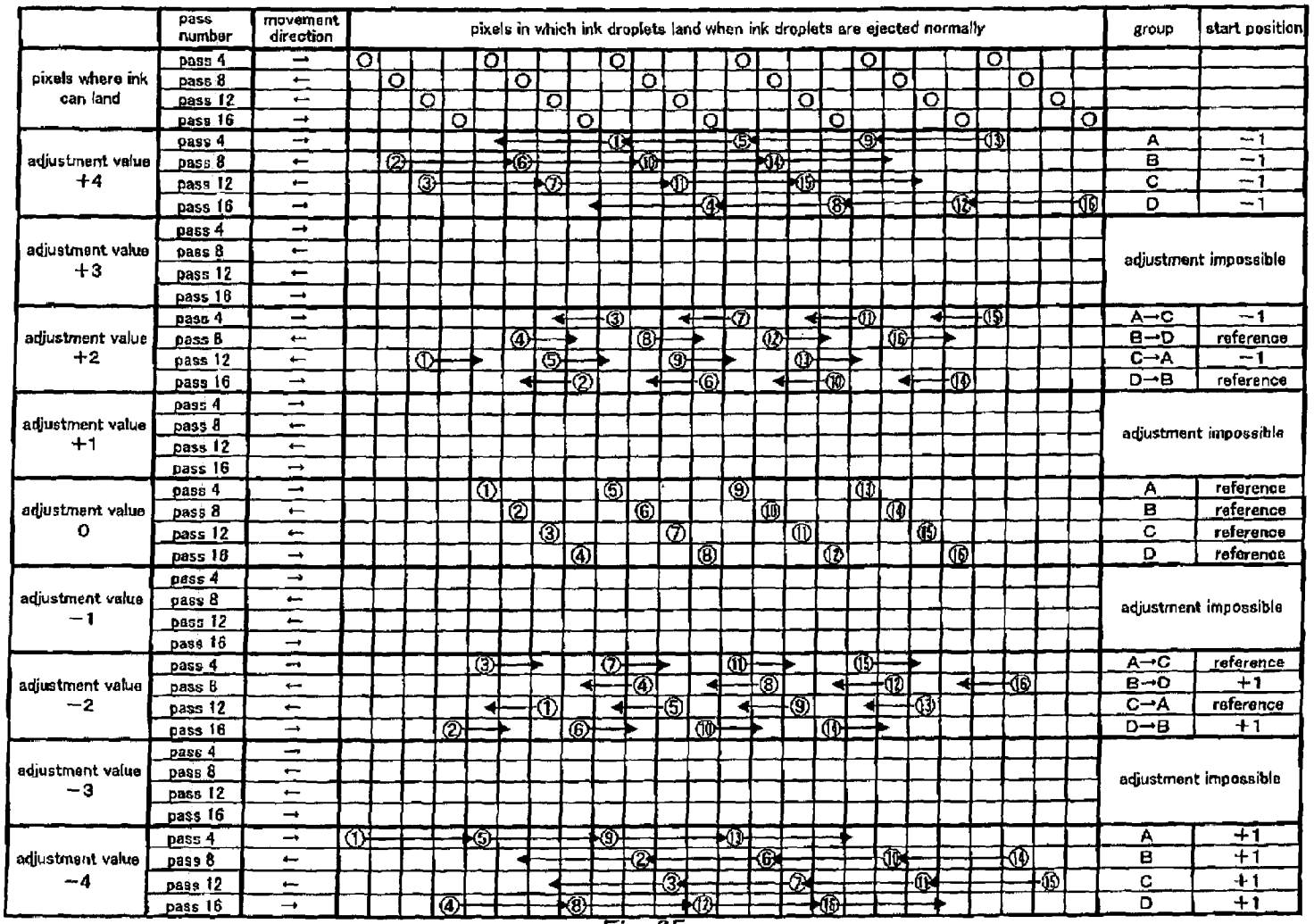
FIG. 35 is an explanatory diagram of a third modified example.

FIG. 35 is an explanatory diagram of a third modified example. In the third modified example, the carriage 31 moves from left to right in passes 4 and 16 and from right to left in passes 8 and 12.

In the third modified example as well, the printer driver and the printer 1 cannot finely adjust the positions where ink droplets land when the adjustment value is "+3," "+1," "−1," and "−3." The reason for this is the same as in the second modified example and thus will not be described in detail here, and for example, if the adjustment value is "−1," then it is not possible to form dots in the pixels shown by circles in the "Pass 12" and "Pass 16" rows of the "Pass Number" column in FIG. 35. It should be noted that the first condition and the second condition mentioned above both are met in the third modified example.

When adjustment is impossible, it is possible for the printer driver and the printer 1 to not perform the adjustment that corresponds to the adjustment value (that is, to perform the processing that corresponds to an adjustment value of "0"). However, if the adjustment value is "−3," then not performing adjustment will result in a large shift in the positions where the dots land, and this will cause a significant drop in image quality. Thus, the printer driver and the printer 1 can perform adjustment that corresponds to the adjustment value nearest to the "−3" adjustment value (such as the adjustment value "−2" or "−4").

(7-4) Others

The foregoing embodiments (the "Present Embodiment" and the Modified Examples 1 through 3) are for the purpose of elucidating the present invention, and are not to be interpreted as limiting the invention. The invention can of course be altered and improved without departing from the gist thereof, and includes equivalents.

The foregoing embodiments describe a printing system that is constituted by the printer 1 and the computer 110. This is not a limitation, however, and it is also possible for the printer 1 to incorporate the function of the printer driver and for rasterization, etc., to be performed by the printer 1. In this case, the printer 1 alone will constitute the printing system.

The foregoing embodiments describe the case of overlapped printing in which a single raster line is formed by four nozzles (M=4 overlapped printing). This is not a limitation, however, and M=2 or M=6 overlapped printing also is possible.

(8) In Summary (8-1)

The above printing system includes a head 41, a carry unit 20, and a controller that is made of a CPU of a computer 110 on which a printer driver is installed and a controller 60 of a printer 1. The head 41 is provided with a plurality of nozzles, and ejects ink droplets that correspond to pixel data from those nozzles (see FIG. 6) The carry unit 20 carries media such as paper. The controller alternately repeats a dot formation operation (also called "pass"; see S205 in FIG. 28) of forming dots in the movement direction by ejecting ink droplets from nozzles moving in the movement direction, and a carrying operation of causing the carry unit to carry the paper (S203), to print an image on the paper.

If overlapped printing is performed as in the foregoing embodiment, then the controller alternately repeats passes to form dots at a pitch of 180 dpi, and shifts the positions of the dots that are formed in each pass by 720 dpi, forming a row of dots that are lined up at a pitch of 720 dpi (see FIGS. 13A through 13D, FIG. 22). It should be noted that in this case, each dot row is formed by four nozzles.

When performing overlapped printing, the controller first divides the raster data (a plurality of pieces of pixel data corresponding to a plurality of pixels lined up in the movement direction) into four groups (see FIG. 18), extracts the pixel data that are necessary for each pass from one of the groups (see FIGS. 19A and 19B), and causes ink droplets to be ejected in each pass.

However, the flight speed of the ink droplets and the spacing between the nozzles and the paper, for instance, in actual printers are not the values that are expected. The positions where ink lands shift as a result, and this may not allow dots to be formed where expected. When the positions where the ink droplets land are shifted, the quality of the printed image becomes poor, and therefore it is desirable to adjust the positions where ink lands.

Accordingly, the above printing system is provided with a memory that stores adjustment values (one example of "position information"). The adjustment values indicate the relationship between the position where a dot is to be formed by an ink droplet that is ejected according to the pixel data and the position of the pixel on the paper corresponding to that pixel data. For example, when the adjustment value is "−1," the dot that is formed by the ink droplet that is ejected according to the pixel data is located one pixel downstream in the carriage movement direction of the position of the pixel on the paper that corresponds to that pixel data.

Adjusting the land position of the ink droplet based on this adjustment value, however, may be associated with a large computational burden with the adjustment method of the first reference example. Further, in the case of overlapped printing, with the adjustment method of the second reference example it is only possible to perform broad adjustments in 1/180-inch increments.

Accordingly, in the present embodiment, the controller assigns one of the four groups to each pass, which are performed repeatedly, based on the adjustment value. For example, if the adjustment value is "0," then the controller assigns group A, group B, group C, and group D, in that order, to pass 4, pass 8, pass 12, and pass 16, respectively. On the other hand, if the adjustment value is "−1" as in FIG. 29, then the controller assigns group B, group C, group D, and group A in that order. In the case of a "−2" adjustment value, the controller assigns group C, group D, group A, and group B in that order.

Correlating the pass and the group based on the adjustment value in this way obviates the need for a computation to add dummy data in accordance with the adjustment value, and thus the computational burden for the adjustment process can be lightened.

(8-2)

The controller 60 (a portion of the "controller") of the above printer is provided with a start position designating section 644A. The start position designating section 644A designates the pixel data to be transferred to the head 41 first. The controller 60 then changes the region that is designated by the start position designating section 644A in each pass according to the adjustment value (one example of the "position information"). For example, when the adjustment value is "0" the controller causes the start position designating section 644A to designate the third region in all passes, but when the adjustment value is "−1," the controller causes the start position designating section 644A to designate the fourth region in pass 16 (see FIG. 29 and FIGS. 31A and 31B). The controller 60 can also change the ejection start timing for starting ejection of an ink droplet by changing the region that is designated by the start position designating section 644A (see FIGS. 27A and 27B).

Thus, changing the ejection start timing in accordance with the adjustment value allows the computation for adding dummy data that correspond to the adjustment value to be obviated, and thus the computational burden when performing the adjustment process can be reduced. (It should be noted that the amount of dummy data that are added in S105 of FIG. 28 is fixed and does not depend on the adjustment value.)

(8-3)

The above printing system is provided with the printer 1 and the computer 110 installed with a printer driver. It should be noted that the printer 1 includes the controller 60, which is a "portion of the controller", and the computer 110 includes the CPU (not shown), which is a "portion of the controller".

The adjustment value differs for each printer due to individual differences between printers, and this makes it difficult to incorporate adjustment values into a generalized printer driver. Thus, it is desirable that the adjustment value of the printer 1 is stored on the memory 63 of the printer 1. On the other hand, the computer 110 requires the adjustment values for the specific printer 1 in order to perform rasterization when generating print data.

Accordingly, when performing the adjustment process, the printer driver (in practice, the CPU of the computer 110) reads an adjustment value from the memory 63 of the printer 1 (see S107 in FIG. 28) and creates print data for each pass by performing rasterization based on the adjustment value (see FIG. 30) and sends these print data to the printer (see S107 in FIG. 28). Thus, the controller 60 of the printer 1 receives the print data from the computer 110, and if ink droplets are ejected based on those print data, it will be possible to adjust the positions where the ink droplets land.

(8-4)

When causing ink droplets to be ejected according to the print data, the controller 60 of the printer 1 can read the adjustment value from the memory 63 and change the ejection start timing for starting ejection of the ink droplets in each pass by controlling the start position designating section 644A based on the adjustment value.

Thus, it is not necessary to include data relating to the adjustment value, and this allows the print data amount to be reduced.

(8-5)

The printer driver also can include data relating to the adjustment value in the print data before sending the print data. In this case, the controller 60 of the printer 1 can control the start position designating section 644A based on the adjustment value that is included in the print data to change the ejection start timing of the ink droplets in each pass.

Thus, the printer driver, which generates the pixel data for the passes, can control the ejection start timing.

(8-6)

In the case of bidirectional printing, under certain predetermined conditions, it is not possible to perform adjustment (see FIGS. 34 and 35). In this case, the controller performs the dot formation operation without taking the adjustment value into account.

(8-7)

In particular, the controller performs the dot formation operation without taking the adjustment value into account in a case where: when the adjustment value is "0", two pieces of pixel data corresponding to two pixels that are separated by 2×n pixels are respectively assigned to passes in which the nozzles are moved in opposite directions; and the adjustment value is ±n.

For example, in FIG. 34, when the adjustment value is "0" the #1 pixel data and the #3 pixel data correspond to two pixels that are separated by two pixels, and the #1 pixel data is assigned to pass 4, in which the nozzles move from left to right, and the #3 pixel data is assigned to pass 12, in which the nozzles move from right to left. When the adjustment value is "−1" under these circumstances, there will be pixels in which dots cannot be formed and adjustment will not be possible. Thus, the controller performs the dot formation operation without taking the adjustment value into account.

(8-8)

In a situation where adjustment is not possible, the controller associates the passes and the groups with one another in the same way as when the adjustment value is "0." Since printing is executed without performing adjustment, there is no computational burden associated with the adjustment process. This also allows the user to obtain the normal print image.

(8-9)

Further, in a situation where adjustment is not possible, it is also possible for the controller to perform adjustment based on the adjustment value that is nearest to the intended adjustment value. For example, in the case of FIG. 34, if the adjustment value is "−3," then processing according to the adjustment value nearest to the "−3" adjustment value (such as adjustment value "−2" or adjustment value "−4") is performed. This allows the user to obtain a print image that has higher quality than the image that would be obtained if the adjustment process was not performed.

(8-10)

The memory (not shown) on the computer 110 side or the memory 63 on the printer 1 side stores four pixels of pixel data per address. Thus, adding dummy data that correspond to the adjustment value may become computation intensive.

In contrast to this, the adjustment method described above does not include a process for adding dummy data in accordance with the adjustment value (there only is the procedure for adding a fixed amount of dummy data), and thus the computational burden that is placed on the controller can be reduced.

(8-11)

The head 41 described above includes a plurality of nozzles for each color (see FIG. 6). The controller uses a common timing signal that indicates the ink ejection timing for all colors to cause ink droplets to be ejected from the nozzles groups for each color at a common timing (see FIG. 22).

It therefore is not necessary to provide a timing generation section 642 for each color, and this allows the device to be simplified.

What is claimed is:

1. A printing system comprising:

(A) a head that is furnished with a plurality of nozzles and that ejects ink droplets that correspond to pixel data from each of the nozzles;

(B) a carry unit that carries a medium;

(C) a memory storing position information that indicates a relationship between a position of a dot to be formed by an ink droplet that is ejected according to the pixel data and a position of a pixel on the medium that corresponds to that pixel data; and (D) a controller that alternately repeats a dot formation operation of causing ejection of the ink droplets from the nozzles which move in a movement direction to form the dots in the movement direction, and a carrying operation of causing the carry unit to carry the medium, to print an image on the medium;

wherein, when forming a row of dots lined up in the movement direction with a predetermined number of at least two nozzles by repeating the dot formation operation of forming dots at a predetermined pitch in the movement direction and shifting the positions, in the movement direction, of the dots that are formed in each dot formation operation, the controller divides a plurality of pieces of the pixel data that correspond to a plurality of the pixels lined up in the movement direction into groups of a number equal to the predetermined number, assigns, based on the position information, one of the predetermined number of groups to each of the dot formation operations that are repeated, and in each dot formation operation, causes ejection of the ink droplets based on the pixel data included in the group that has been assigned.

2. The printing system according to claim 1, wherein the controller changes an ejection start timing for starting ejection of the ink droplets in each dot formation operation in accordance with the position information.

3. The printing system according to claim 2, further comprising:

a printing apparatus that has a portion of the controller; and a print control apparatus that has a portion of the controller and that controls the printing apparatus;

wherein the memory is provided in the printing apparatus;

wherein the controller on the print control apparatus side reads the position information from the memory, creates print data for each dot formation operation based on the position information, and sends the print data to the printing apparatus; and wherein the controller on the printing apparatus side receives the print data from the print control apparatus and causes the ink droplets to be ejected based on the print data.

4. The printing system according to claim 3, wherein, when causing the ink droplets to be ejected based on the print data, the controller on the printing apparatus side reads the position information from the memory and changes the ejection start timing for starting ejection of the ink droplets in each dot formation operation based on this position information.

5. The printing system according to claim 3, wherein the controller on the print control apparatus side includes, in the print data, the position information that it has read from the memory and then sends the print data to the printing apparatus; and wherein the controller on the printing apparatus side changes the ejection start timing for starting ejection of the ink droplets in each dot formation operation based on the position information that has been included in the print data.

6. The printing system according to claim 1, wherein the dot formation operation performed by the controller is not based on the position information in a case where:

the controller causes bidirectional printing to be performed, and the position information takes a predetermined value.

7. The printing system according to claim 6, wherein the dot formation operation performed by the controller is not based on the position information in a case where;

when the position information indicates that there is no shifting in the relationship, two pieces of pixel data that correspond to two pixels that are separated by 2×n pixels are respectively assigned to dot formation operations in which the nozzles are moved in opposite directions, and the position information indicates that the relationship is shifted by n pixels.

8. The printing system according to claim 6, wherein the controller assigns one of the predetermined number of groups to each of the dot formation operations that are repeated, like when the position information indicates that there is no positional shifting in the relationship.

9. The printing system according to claim 6, wherein the controller assigns one of the predetermined number of groups to each of the dot formation operations that are repeated, like when the position information indicates that the relationship is shifted by n+1 pixels or n−1 pixels.

10. The printing system according to claim 1, wherein a storage section storing the pixel data stores a plurality of pieces of pixel data in one address.

11. The printing system according to claim 1, wherein the head is provided with a plurality of the nozzles for each color; and wherein the controller causes the ink droplets to be ejected from the plurality of the nozzles for each color at a common timing.

12. A printing method comprising:

(A) alternately repeating, a dot formation operation of ejecting ink droplets that correspond to pixel data from a plurality of nozzles that move in a movement direction, to form dots in the movement direction, and a carrying operation of carrying a medium, to print an image on the medium;

(B) storing, in advance, position information that indicates a relationship between a position of a dot to be formed by an ink droplet that is ejected according to the pixel data and a position of a pixel on the medium that corresponds to that pixel data; and (C) when forming a row of dots lined up in the movement direction with a predetermined number of at least two nozzles by repeating the dot formation operation of forming dots at a predetermined pitch in the movement direction and shifting the positions, in the movement direction, of the dots that are formed in each dot formation operation, dividing a plurality of pieces of the pixel data that correspond to a plurality of the pixels lined up in the movement direction into groups of a number equal to the predetermined number, assigning, based on the position information, one of the predetermined number of groups to each of the dot formation operations that are repeated, and in each dot formation operation, causing ejection of the ink droplets based on the pixel data included in the group that has been assigned.

13. An adjustment method for a printing apparatus that alternately repeats a dot formation operation of ejecting ink droplets that correspond to pixel data from a plurality of nozzles that move in a movement direction, to form dots in the movement direction, and a carrying operation of carrying a medium, to print an image on the medium, the adjustment method comprising:

(A) storing, in advance, position information that indicates a relationship between a position of a dot to be formed by an ink droplet that is ejected according to the pixel data and position of a pixel on the medium that corresponds to that pixel data; and (B) when forming a row of dots lined up in the movement direction with a predetermined number of at least two nozzles by repeating the dot formation operation of forming dots at a predetermined pitch in the movement direction and shifting the positions, in the movement direction, of the dots that are formed in each dot formation operation, dividing a plurality of pieces of the pixel data that correspond to a plurality of the pixels lined up in the movement direction into groups of a number equal to the predetermined number, assigning, based on the position information, one of the predetermined number of groups to each of the dot formation operations that are repeated, and in each dot formation operation, causing ejection of the ink droplets based on the pixel data included in the group that has been assigned.

* * * * *